United States Patent [19]

Peck et al.

[11] 4,389,861

[45] Jun. 28, 1983

[54] MACHINE ADAPTED FOR USE IN THE MANUFACTURE OF SHOES

[75] Inventors: Alan M. Peck, Beverly, Mass.; Kingsley J. Tutt, Birstall; Graham J. Mansfield, Oadby, both of England

[73] Assignee: USM Corporation, Farmington, Conn.

[21] Appl. No.: 271,586

[22] Filed: Jun. 8, 1981

[51] Int. Cl.[3] ..... C14B 1/44

[52] U.S. Cl. ..... 69/6.5

[58] Field of Search ..... 69/6.5

[56] References Cited

U.S. PATENT DOCUMENTS 3,704,604 12/1972 Boot et al. ..... 69/6.5

4,020,660 5/1977 Bergeron ..... 69/6.5

*Primary Examiner*—Patrick D. Lawson

*Attorney, Agent, or Firm*—Donald N. Halgren

[57] ABSTRACT

Apparatus for the combined marginal roughing and toe scouring of shoe bottoms has a shoe support movable in an arcuate path past marginal roughing tools and a scouring tool, the roughing tools being movable widthwise and heightwise of the shoe bottom, and the scouring tool heightwise. All the movements are under the control of n.c. motors. The scouring tool thus follows a pre-determined path, giving enhanced control of the degree of scouring. To assist in accuracy, the shoe support has height datum means which, after use and subsequent to toe support means being locked in adjusted position, are moved out of the way so as not to impede the roughing and scouring.

6 Claims, 11 Drawing Figures

10
24
26
30
32
34
38
40
42
44
46
48
50
52
54
56
58
60
62
64
66
68
70
72
74
76
82
84
86
88
90
92
100
102
104
106
110
112
134
208
210
212
214
216
218
220
222
224
226
228
230
232
286
288
290
292
294
VII

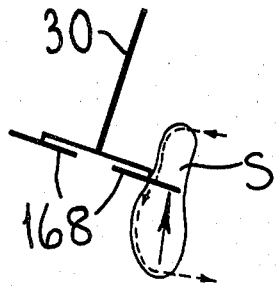
Fig. 11
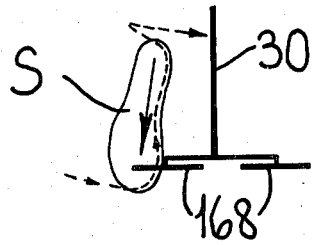
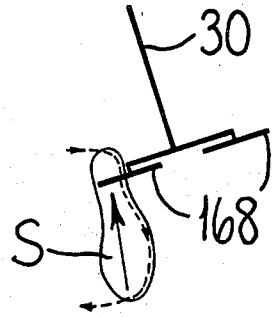
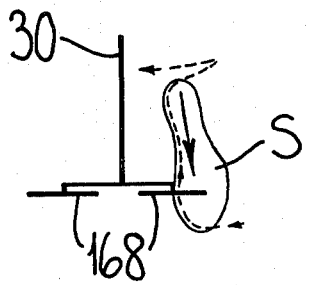

MACHINE ADAPTED FOR USE IN THE MANUFACTURE OF SHOES

BACKGROUND OF THE INVENTION (1) Field of the Invention

This invention is concerned with machines adapted for in the manufacture of shoes, more especially with machines for operating, e.g. performing a roughing operation, progressively along marginal portions of shoe bottoms and/or for performing a scouring action on end portions of shoe bottoms. The term "shoe" is used herein generically as indicating articles of outer footwear, and as including articles of outer footwear in the course of their manufacture.

(2) Prior Art

In one known machine for performing a roughing operation progressively along marginal portions of a shoe bottom, there are provided a shoe support, for supporting a lasted shoe, bottom uppermost, tool supporting means for supporting two rotary roughing tools in the form of wire brushes, and means for effecting relative movement, lengthwise of the bottom of a shoe supported by the shoe support, between the shoe support and the tool supporting means in one direction along a path, template means being provided, mounted on the shoe support, whereby, as relative lengthwise movement takes place as aforesaid, relative movement, widthwise of the bottom of a shoe supported by the shoe support, is also caused to take place between the shoe support and the tool supporting means, so that the tools supported by the tool supporting means can operate progressively along opposite marginal portions of the shoe bottom. Furthermore, in said machine, the tools are arranged in tandem relationship so that, as relative lengthwise movement takes place as aforesaid, first one tool engages the shoe bottom and operates along one marginal portion, and thereafter, following said one tool, the other tool engages the shoe and operates along the opposite marginal portion, the arrangement being such that the relative lengthwise movement is arrested when said other tool has completed its operation. Thereafter, with the tools in an out-of-the-way condition, relative lengthwise movement may then take place in an opposite direction along said path and the shoe can then be removed from the shoe support.

Whereas the machine referred to above operates satisfactorily on a variety of shoe styles and sizes, nevertheless it will be appreciated that the machine cycle includes a certain amount of "dead" time, in which the shoe bottom is not being operated upon but is merely being returned to a loading position. Furthermore, by arranging the tools in tandem relationship, the amount of relative lengthwise movement necessary for both brushes to traverse their respective marginal portions is greater than the overall length of the shoe, and this in turn leads to an extended machine cycle time.

Furthermore, the brushes always operate on the shoe bottom in the same direction, so that the "leading" edge of the operating surface of each brush is more subject to wear than the "trailing" edge of that surface, with the result that uneven brush wear takes place with consequently shortening of the effective life of the brush.

The use of template means in the aforementioned machine is highly efficient in ensuring that the path of relative movement followed by the roughing tools in relation to the shoe bottom being operated upon is closely controlled so that roughing of the shoe bottom is effected only in the areas intended to be roughed. This is of special importance insofar as any "over-roughing" of the shoe bottom, i.e. roughing beyond the featherline, will be visible in the finished shoe (unless of course the shoe construction requires such "over-roughing", e.g. if the sole unit to be applied extends up the sides of the finished shoe, in which case the machine employing the template means can be so set to control the degree of "over-roughing"). Similarly, "under-roughing" may provide an insufficient area of roughed material to ensure a good bond with the sole unit to be attached; furthermore, "under-roughing" means that the area of rough does not extend up to the featherline, so that gaping may arise in the finished shoe between the attached sole unit and the lasted-over portions of the upper.

Template means do, however, present a problem of storage, especially in cases where one template is provided for each size, or perhaps for two or three half-sizes, of a given style. To overcome this problem, it has been proposed to use a single, adjustable template for each style, but such an arrangement has not proved satisfactory. Furthermore, in other machines for performing a roughing operation progressively along marginal portions of shoe bottoms, in order to avoid the use of template means, it has been proposed to use the edge of the shoe itself for purposes of guiding the tool(s). However, problems may arise in such a case in that, especially in the instep region of the shoe bottom, the edge of the shoe bottom may be insufficiently defined satisfactorily to guide a tool along the shoe bottom marginal portion.

Furthermore, prior to effecting a marginal roughing operation, whether by one or other of the aforementioned machines or whether by hand, it is customary first to remove any significant pleats which have been formed, during the preceding lasting operation, especially at the toe end of the shoe, such removal generally being effected using a rotating toe scouring roll or a toe scouring band to which the shoe bottom is presented manually. At least when using the machine first mentioned above, this manual toe scouring operation can be effected during the marginal roughing machine cycle without significantly affecting the cycle time. However, if the cycle time were to be shortened to any significant extent, then manual toe scouring could no longer be effected.

Again, in the machine first mentioned above means is provided for maintaining the brushes in a sharpened condition, said means including stationary grinding stones contoured to the desired shape of the operating surface of each brush. In using such means, in order that the burrs formed during sharpening will be directed so as to improve the cutting effect of the brush during the roughing operation, it is necessary to reverse the direction of rotation of each brush for the grinding operation. After grinding, of course, the direction of rotation has to be once more reversed back to the "roughing" direction. To this end, clearly a reversible motor has to be used for the rotation of each brush. Furthermore, since grinding takes place relatively frequently (e.g. desirably once every 20 or so machine cycles), the constant starting and stopping of the motor tends to shorten the life of the motor. Again, because of the need to reverse the direction of rotation of each brush twice for each grinding operation, a good deal of operating time is lost for each grinding operation.

BRIEF SUMMARY OF THE INVENTION

The present invention thus provides, in one of its several aspects, a machine suitable for performing a roughing operation progressively along marginal portions of shoe bottoms comprising a shoe support, tool supporting means, means for effecting relative movement, lengthwise of the bottom of a shoe supported by the shoe support, between said shoe support and the tool supporting means first in one direction and then in an opposite direction, and means, operable as relative lengthwise movement takes place as aforesaid, for effecting relative movement, widthwise of the bottom of a shoe supported by the shoe support, between said shoe support and the tool supporting means, whereby, in the operation of the machine, a roughing operation can be progressively performed along marginal portions of such shoe bottom, wherein the tool supporting means is arranged to support two radial roughing tools (as hereinbefore defined) side-by-side for operating along opposite marginal portions of the shoe bottom, the arrangement being such that each tool is caused to effect an in-wiping action on the marginal portion on which it is caused to operate, and further wherein, in a cycle of operation of the machine, a left-hand one of said tools is caused to operate along the marginal portion of the shoe bottom at the right-hand side thereof during relative lengthwise movement as aforesaid in said one direction, and the right-hand one of said tools is caused to operate along the marginal portion of such shoe bottom at the left-hand side thereof during said relative lengthwise movement in said opposite direction.

In this way, not only is the path of relative lengthwise movement shortened, since the brushes are no longer arranged in a tandem relationship, but further, by arranging for each tool to operate along the "opposite" side of the shoe bottom, the change-over from one tool to the other at the end of the relative lengthwise movement in said one direction can be minimized in that, as the first tool leaves engagement with the shoe bottom, the other tool is brought into engagement therewith. This advantage is especially the case where, as preferred, the tool supporting means comprises a single support member by which both roughing tools are supported.

It has further been found desirable that the shoe support is arranged to support a shoe in such a manner that, as relative lengthwise movement is effected in said one direction, a roughing operation is performed along the marginal portion of the shoe bottom at one side thereof from the heel end to the toe end thereof, and, as such relative lengthwise movement is effected in the opposite direction, a roughing operation is performed along the marginal portion of the shoe bottom at the opposite side, from the toe end to the heel end thereof.

Conveniently in the machine in accordance with the invention, for effecting relative movement, lengthwise of the shoe bottom as aforesaid, the shoe support is mounted for movement in a first direction and then in a return direction (corresponding respectively to said one and said opposite directions of relative lengthwise movement), thus to move the bottom of a shoe supported thereby progressively past the tools supported by the tool supporting means, while, for effecting relative movement, widthwise of the shoe bottom as aforesaid, the tool supporting means is mounted for movement transversely of the path of relative lengthwise movement between the tool supporting means and the shoe support. In addition, means may also be provided by which relative movement, heightwise of the shoe bottom, can be effected between the shoe support and the tool supporting means, thus to control the position of the or each tool relative to the shoe bottom, and to cause said tool(s) to follow the heightwise contour of the shoe bottom when caused to operate along marginal portions thereof as aforesaid.

More specifically, preferably the shoe support is mounted for swinging movement about a horizontal axis, thus to effect movement, lengthwise of the shoe bottom, relative to the tool supporting means as aforesaid, while the tool supporting means is mounted for pivotal movement about a vertical, or substantially vertical, axis, whereby tools supported thereby can move in a direction extending widthwise of the shoe bottom, and also for pivotal movement about a horizontal, or substantially horizontal, axis, whereby the tool(s) supported thereby can move in a direction extending heightwise of the shoe bottom.

The invention also provides, in another of its several aspects, a machine for performing a roughing operation progressively along marginal portions of shoe bottoms comprising a shoe support for supporting a lasted shoe, bottom uppermost, and tool supporting means for supporting a roughing tool, wherein the shoe support is mounted for movement in a direction extending lengthwise of the bottom of a shoe supported thereby, along an arcuate path about an axis extending transversely of the shoe bottom, thus to move the shoe past the tool supported by the tool supporting means, and the tool supporting means is mounted for movement to cause the tool supported thereby to move in a direction extending widthwise of the bottom of the shoe supported by the shoe support, as the shoe support is moved as aforesaid, whereby the tool is caused to operate progressively along a marginal portion of the shoe bottom.

The tool supporting means may further be so arranged that the tools are supported thereby for pivotal movement about a horizontal axis passing through the area of engagement between each tool and the shoe bottom. More specifically, the tools may be mounted in a sub-frame (forming part of the tool supporting means), said sub-frame being mounted for pivotal movement as aforesaid. In this manner, the plane of each tool may be maintained normal to the portion of the shoe bottom being operated upon by such tool, as such tool is caused to operate progressively along a marginal portion of the shoe bottom.

The invention also provides, in another of its several aspects, a machine for performing a roughing operation progressively along marginal portions of a shoe bottom, comprising a shoe support for supporting a lasted shoe, bottom uppermost, and tool supporting means for supporting a radial roughing tool, means being provided for effecting relative movement between the shoe support and the tool supporting means whereby, in the operation of the machine, a roughing operation can be performed progressively along marginal portions of the bottom of a shoe supported by the shoe support, wherein the tool is supported by the tool supporting means for pivotal movement about a horizontal axis passing through the area of engagement between a tool supported thereby and the bottom of a shoe supported by the shoe support, and means is provided for effecting such pivotal movement of the tool supporting means whereby a tool supported thereby can be maintained with the plane in which its operating surface lies normal, or substantially normal, to the marginal portion of the shoe bottom as said tool operates therealong as aforesaid.

The machine in accordance with the invention is readily capable of being adapted to operate under the control of computer means, and to this end conveniently each of the means for effecting relative movement, respectively lengthwise, widthwise and heightwise of the bottom of a shoe supported by the shoe support, between the tool supporting means and the shoe support comprises a stepping motor operable in response to drive pulses generated and supplied to said motor by computer means in accordance with a programmed instruction, including digitized co-ordinate axis values, using three co-ordinate axes, for a plurality of successive selected points along the marginal portion to be operated upon of a shoe bottom.

The invention thus further provides, in another of its several aspects, a machine suitable for operating progressively along marginal portions of shoe bottoms comprising a shoe support for supporting a shoe, bottom uppermost, with a marginal portion to be operated upon of the bottom thereof exposed, tool supporting means, a first stepping motor for effecting relative movement, lengthwise of the bottom of a shoe supported by the shoe support, between said shoe support and the tool supporting means, a second stepping motor for effecting relative movement, widthwise of such shoe bottom, between the shoe support and the tool supporting means, and a third stepping motor for effecting relative movement, heightwise of such shoe bottom, between the shoe support and the tool supporting means, the machine also comprising computer control means by which drive pulses are generated and supplied to the stepping motors, in accordance with a programmed instruction, including digitized co-ordinate axis values, using three co-ordinate axes, for a plurality of successive selected points along the marginal portion to be operated upon of a shoe bottom, whereby, in the operation of the machine, marginal portions of such shoe bottom can be operated upon progressively.

Furthermore, for effecting pivotal movement of the tools about a horizontal axis as aforesaid, a further stepping motor may also be provided, operable in response to drive pulses generated and supplied to said motor by the computer means in accordance with said programmed instruction.

Furthermore, each tool supported by the tool supporting means may have associated therewith sensing means by which the pressure applied by such tool to the shoe bottom can be gauged, and which is responsive to changes in such pressure to cause relative movement to take place heightwise of the shoe bottom between the shoe support and the tool supporting means. In this manner, any deviations in heightwise contour of the shoe bottom being operated upon from the digitized information can be accommodated. Preferably, said sensing means is effective to supply control signals to the computer control means, which is thus caused to modulate the drive pulses supplied thereby to the stepping motor for effecting relative heightwise movement between the tool supporting means the shoe support as aforesaid. Conveniently, in response to the control signals, the computer control means is effective to vary the frequency and/or polarity of the drive pulses to the stepping motor thus to vary the output velocity thereof.

The invention still further provides, in another of its several aspects, a machine suitable for operating progressively along marginal portions of shoe bottoms, comprising a shoe support, tool supporting means, and means for effecting relative movement, both lengthwise and widthwise of the bottom of a shoe supported by the shoe support, between the shoe support and the tool supporting means whereby a tool supported by the tool supporting means is caused to operate progressively along a marginal portion of the shoe bottom, the machine also comprising means whereby the heightwise position of such tool, as it is caused to operate as aforesaid, relative to the shoe bottom is varied according to the heightwise contour of the shoe bottom, wherein the last mentioned means comprises a stepping motor, sensing means also being provided by which the pressure applied by the tool supported by the tool supporting means to the bottom of a shoe being operated upon can be gauged and which, in response to changes in such pressure, is effective to supply control signals to computer control means which in turn generates corresponding drive pulses and supplies them to the stepping motor.

It will thus be appreciated that a machine as set out in the last preceding paragraph would rely on such stepping motor for controlling the heightwise position of the tool in relation to the shoe bottom, while any desired means could be provided for controlling relative lengthwise and widthwise movement between the shoe support and the tool supporting means. Of course, preferably in such a machine the computer control means is arranged to generate and supply drive pulses to the stepping motor in accordance with a programmed instruction, including digitized co-ordinate axis values for a plurality of successive selected points along the marginal portion to be operated upon of a shoe bottom, thus to cause the heightwise position of the tool in relation to the shoe support to be determinatively controlled, and further the control pulses from the sensing means are effective to cause such drive pulses to be correspondingly modulated. In such a machine, furthermore, a facility would be readily provided, by the control of the heightwise position of the tool, for operating e.g. on strap sandals.

Where the or each tool is supported by the tool supporting means for pivotal movement about a horizontal axis passing through the area of engagement between each tool and the shoe bottom as aforesaid, furthermore, it is necessary, as the tool wears, to ensure that the operating surface thereof remains in a datum plane through which said horizontal axis passes. To this end, in a machine in accordance with the invention, preferably means is provided for moving each tool heightwise of the tool supporting means to bring its operating surface into such datum plane. Furthermore, said means preferably comprises a stepping motor.

In addition, where means as set out in the last preceding paragraph is provided, such means may be utilized in a grinding operation whereby the operating surface of each tool can be ground, to maintain its sharpness. To this end, therefore, grinding means may also be provided, comprising, for each tool, a grinding stone, and the stepping motor may then be effective to move each tool in a direction towards its associated grinding stone, the arrangement being such that the tool supporting means is moved through a first distance (corresponding to the distance between said datum plane and the operating surfaces of the grinding stones) by the means for effecting relative heightwise movement between the tool supporting means the shoe support and the tools are moved by said stepping motor through a further distance (thus to ensure that grinding of each tool can take place), and thereafter the tool supporting means is moved in an opposite direction, to move each tool away from its associated grinding stone, through said first distance. In this manner, it is ensured that, following a grinding operation, each tool is returned to bring its operating surface into said datum plane. Furthermore, in a cycle of operation of the machine, for such grinding operation, the tool supporting means may be caused to move in a direction extending widthwise of the bottom of a shoe supported by the shoe support, to bring the tools supported thereby into opposed relationship with the grinding means.

Furthermore, in the machine in accordance with the invention, the grinding stones are preferably caused to rotate with a peripheral speed greater than that of the peripheral speed of the tools, the arrangement being such that the operating surfaces of each tool and its associated stone are moving in the same direction at the point of engagement therebetween. In this manner, the need, in previous machines, to arrest rotation of the tool and to reverse its rotation prior to grinding, using a stationary grinding stone, is avoided.

The machine in accordance with the invention may also be provided with means for supporting a scouring tool by which a scouring operation can be effected on the bottom of a shoe supported by the shoe support, at the toe end portion thereof, said scouring tool being movable into and out of an operating condition in engagement with the bottom of such shoe to be scoured, and the tool being further arranged to operate on said shoe bottom, as relative lengthwise movement takes place between the roughing tool supporting means and the shoe support in said one direction as aforesaid. For effecting movement of the scouring tool into and out of its operating condition, means, comprising a further stepping motor, is preferably provided by means of which the heightwise position of said scouring tool in relation to said shoe bottom is controlled while said tool is in such operating condition, said stepping motor also being supplied with drive pulses generated by the computer control means in accordance with a programmed instruction including digitized co-ordinate axis values for a plurality of successive selected points along the shoe bottom to be scoured.

The invention thus also provides, in another of its several aspects, a machine for performing marginal roughing and toe scouring operations on shoe bottoms comprising a shoe support for supporting a shoe, bottom uppermost, roughing tool supporting means for supporting a roughing tool, means for effecting relative movement, lengthwise and widthwise of the bottom of a shoe supported by the shoe support, between said shoe support and the roughing tool supporting means, whereby, in the operation of the machine, a roughing operation can be progressively performed along a marginal portion of the shoe bottom, and scouring tool supporting means for supporting a scouring tool, wherein when relative movement, lengthwise of the shoe bottom, takes place between the roughing tool supporting means and the shoe support, relative movement lengthwise of the shoe bottom, also takes place between the scouring tool supporting means and the shoe support, whereby, in the operation of the machine, a scouring operation can be performed in the toe region of the shoe bottom, the machine also comprising means for determining the heightwise position of a scouring tool supported by said scouring tool supporting means in relation to the shoe support, during such relative lengthwise movement, whereby to control the amount of material remaining after the scouring operation has been effected on the shoe bottom.

Where, in the machine in accordance with the invention, the shoe support is mounted for movement about a horizontal axis, so that it moves through an arcuate path, as aforesaid, the roughing tool supporting means is arranged to support the tools located adjacent the highest point of said arcuate path, or substantially so, while the scouring tool supporting means is arranged to support the scouring tool located just "upstream" of such roughing tool, as the shoe support moves in said one direction. Furthermore, the shoe support is preferably arranged to support a shoe with its heel end leading during such relative lengthwise movement between the scouring tool supporting means and the shoe support, so that the scouring tool is caused to operate progressively from the forepart to the toe end of the shoe bottom. The scouring tool is preferably in the form of a rotary abrasive member, e.g. a cylindrical abrasive roller, which is driven in such a manner that the direction of relative movement between the shoe bottom and the operating surface portion of the tool engaging it is the same as that in which relative lengthwise movement is taking place between the scouring tool supporting means and the shoe support.

The invention still further provides, in another of its several aspects, a shoe support for use in a machine for operating along marginal portions of shoe bottoms, said shoe support comprising toe end support means, a heel end support arrangement, and means for effecting relative movement of approach therebetween to accommodate to the size of shoe to be supported thereby, wherein a "shoe present" sensing device is provided upon actuation of which relative movement of approach is caused to take place between the toe end support means and heel end support arrangement.

Conveniently, the "shoe present" sensing device, which may comprise an air bleed arrangement sealing of which causes it to be actuated, is supported by the toe end support means in such a manner that it can be actuated by a shoe placed in said toe end support means. In this manner, the action of placing a shoe in the toe end support means itself initiates the cycle of operation of the machine, with consequent ergonomic and time-saving effect.

The shoe support is preferably provided with sensing means for sensing whether a shoe supported thereby is a left or a right. Such sensing means, furthermore, is effective, where the machine is computer-controlled, to supply control signals to the computer means according to whether the shoe sensed thereby is a left or a right. A preferred form of sensing means, furthermore, comprises an inductance sensing device responsive to changes in distance between itself and a co-operating element, the arrangement being such that the distance between said element and said device varies according to whether the shoe supported by the shoe support is a left or a right. Preferably, furthermore, said sensing means is associated with heel clamping means of the heel end support arrangement of the shoe support, which heel clamping means, for clamping a heel end of a shoe supported by the shoe support, comprises a set of clamps engageable with the shoe in the region of the topline thereof, the sensing device and co-operating element being relatively movable, as the set of clamps is caused to engage the heel end of the shoe. In this regard, it will be appreciated that the topline of the shoe varies significantly as between a left and right shoe, so that by utilizing the set of clamps by which the topline region is clamped, a significant variation of the position of the clamps in the shoe support, and thus a significant variation in the relative positions of the sensing device and co-operating element can be achieved.

In addition, the shoe support preferably also comprises a shoe length detecting arrangement by means of which the length of a shoe supported by the shoe support can be "read". Such an arrangement may comprise a rotary potentiometer which may be caused to rotate, and the resistance of which is thereby caused to be varied, as relative movement of approach is caused to take place between the toe end support means and the heel end support arrangement as aforesaid. For example, where the toe end support means is mounted for movement towards the heel end support arrangement, a cable may be connected with said support means, which cable is operatively connected to the rotary potentiometer to cause it to rotate as said support means is caused to move towards said support arrangement. The shoe length detecting arrangement is conveniently utilized for automatically varying the path of relative movement between the tools and the shoe bottom according to the size of shoe, and to this end conveniently the computer control means has a grading programme which, in response to a signal from the shoe length detecting arrangement, when the machine is in an operating mode, causes the drive pulses to the stepping motors to be modulated in accordance with the shoe length thus detected. It will be appreciated that the grading programme includes a sub-programme for proportionately varying the widthwise dimensions of the shoe in respect of the lengthwise dimensions thereof. More specifically, when the computer control means "reads" the length of the shoe bottom to be operated upon, it effectively appropriately varies (as compared with the digitized shoe bottom) the length of each increment of advance, that is the distance between successive points which were selected for digitizing.

In the preferred embodiment of the machine in accordance with the invention two shoe supports are provided, arranged side-by-side, the arrangement being such that the tool supporting means is caused to be aligned alternately with each shoe support. Of course, if desired, such alternate alignment may be over-ridden. For achieving alignment of the tool supporting means with a shoe support, the means for effecting relative widthwise movement between the tool supporting means and the shoe support is employed. Furthermore, for achieving time saving in the operation of the machine, when operating alternately on shoes presented by the two shoe supports, the marginal portion of the side of the shoe bottom remote from the other shoe support is first operated upon and thereafter the marginal portion of the side nearer said other shoe support. In this way, as the second tool moves out of engagement with the shoe bottom, when the shoe support has moved in said opposite direction (back to the loading position), a reversal of the direction of widthwise movement of the tool supporting means takes place, whereafter, as the tool supporting means is moved into alignment with the other shoe support, the appropriate tool moves directly on to the shoe bottom at the required operating velocity. It will thus be appreciated that only one reversal of the direction of widthwise movement of the tool supporting means, other than such a reversal determined by the shoe bottom shape, is required in each machine cycle. Furthermore, by the particular arrangement of operating first on the marginal portion of a shoe bottom remote from the other shoe support, it is ensured that each side of the operating surface of each tool alternately "leads" and "trails" as it is caused to operate progressively along a marginal portion of the shoe bottom, thereby improving the life of the tool.

It will be appreciated that where two shoe supports are provided as aforesaid, two stepping motors are preferably provided, one associated with each shoe support, for effecting relative lengthwise movement between each such shoe support and the tool supporting means, whereas only one stepping motor is required for effecting relative widthwise movement therebetween, and also a further one stepping motor for effecting relative heightwise movement therebetween. Furthermore, it is preferable, where two shoe supports are provided as aforesaid, that two scouring tools are also provided, one associated with each shoe support, and further that two stepping motors are provided, one associated with each scouring tool, for determining the heightwise position of its associated scouring tool in relation to the shoe support during relative lengthwise movement between the shoe support and the scouring tool supporting means.

It will be appreciated that, by utilizing computer control means and stepping motors controlled thereby, the need for template means, in the form of templates of metal or like material, is eliminated, thereby eliminating the storage problem, and furthermore, because of the facility of providing a grading programme in the computer control means, only one set of digitized values is required to be stored in the computer memory for each style, so that the storage of such information in the computer is minimized. A further advantage of using stepping motors under the control of computer control means resides in that it is possible so to control the drive pulses supplied to the stepping motors by the computer control means as to ensure that the speed at which relative lengthwise, widthwise and heightwise movement is effected between the tool supporting means and the shoe support as aforesaid, in the operation of the machine, is so controlled that the speed at which each tool traverses the marginal portion of the shoe bottom remains constant during the operating along the whole of such marginal portion. It will be appreciated that, using metal templates, such a feature cannot readily be achieved.

For providing the computer control means with the necessary digitized information, the machine in accordance with the invention may be provided with manually operable control means by which, in a digitizing mode of the machine, the stepping motors can be caused to be driven in selected directions thus to cause a tool supported by the tool supporting means to be moved in relation to the bottom of a shoe the shape and contour of which is, at selected points, to be digitized, the computer control means comprising a "teach" circuit by which, for each such selected point, said position of the tool is stored by the computer control means in a programmed instruction in terms of digitized co-ordinate axis values. Where such manually operable control means is provided, the shoe length detecting arrangement and also the sensing means for sensing whether a shoe supported by the shoe support is a left or a right supply appropriate information to the computer control means, so that either a left or a right shoe may be digitized to provide the "style pattern", and further any size of shoe within the size range for that style may be selected. Of course, it is preferable that the model size be in the middle of the range.

Where the machine in accordance with the invention is for use in roughing marginal portions of the shoe bottoms, the tools are preferably in the form of wire brushes. However, abrasive-covered tools may also be used, whether in the form of rolls or in the form of abrasive bands running over backing rolls at the point of engagement with the shoe bottom. Whichever tool is used, it is to be considered as a "radial roughing tool" within the context of this specification, and any reference to radial roughing tools is to be understood as including the various form of tool refered to above.

BRIEF DESCRIPTION OF THE DRAWINGS

The various objects and the above and other of the several aspects of the present invention will become clearer from the following detailed description, to be read with reference to the accompanying drawings, of one machine in accordance with the invention, hereinafter called the "illustrative machine". It will be appreciated that this illustrative machine has been selected for description merely by way of exemplification of the invention and not by way of limitation thereof.

In the accompanying drawings:

FIG. 11 is a diagram showing an operating sequence of tools of the illustrative machine on shoe bottoms successively presented thereto.

DESCRIPTION OF THE PREFERRED EMBODIMENTS

Figure 1:
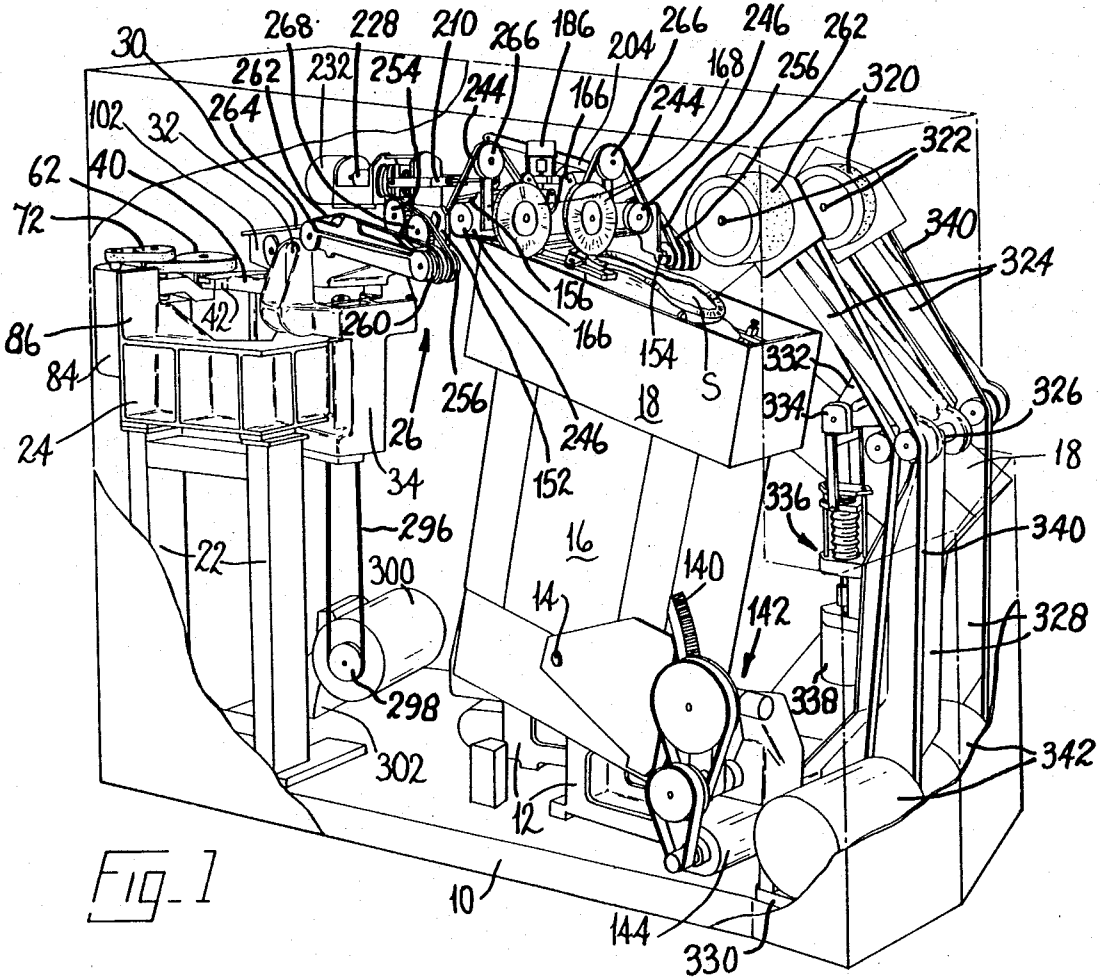
FIG. 1 is a left hand perspective view of the illustrative machine.

The illustrative machine, which is a machine suitable for use in performing a roughing operation progressively along marginal portions of shoe bottoms, comprises a base 10 on which are mounted two upstanding brackets 12 each supporting a pivot shaft 14, each shaft carrying a structure 16 on which a shoe support 18 is carried. Each shoe support 18 is arranged to support a shoe S carried thereon, bottom uppermost, with the toe end thereof facing towards the front of the machine i.e. towards the operator.

Towards the rear of the base 10 of the illustrative machine is mounted a support column structure 22 supporting in turn a horizontal web structure 24 by which tool supporting means generally designated 26 of the illustrative machine is carried.

The tool supporting means comprises a bifurcated arm 30 which is supported, for pivotal movement about a horizontal axis, in upstanding lugs 32, one arranged at either side of the arm 30, of a support casting 34, which is itself supported, above and below the web structure 24, for pivotal movement about a vertical axis.

It will thus be appreciated that, in the operation of the illustrative machine, by moving either one of the shoe supports 18 about the axis of its associated pivot shaft 14, and further by effecting pivotal movement of the arm 32 about said horizontal and vertical axes, relative movement is thus effected, lengthwise, heightwise and widthwise of the bottom of a shoe S supported by said shoe support 18.

More specifically, the support casting 34 is mounted on shafts 36, 38 projecting downwardly and upwardly respectively from the web structure 24 and being accommodated in the casting 34. Furthermore, for effecting pivotal movement about the axis of said shafts 36, 38, a rearwardly extending portion 40 of the support casting 34 has secured thereto a toothed segment 42. For supporting the rearwardly extending portion 40, and the toothed segment 42, furthermore, two vertical rods 44 are threadedly secured in said portion 40 and are carried, at their lower ends, in a base plate 46 which is secured to the underside of the support casting 34.

Figure 7:
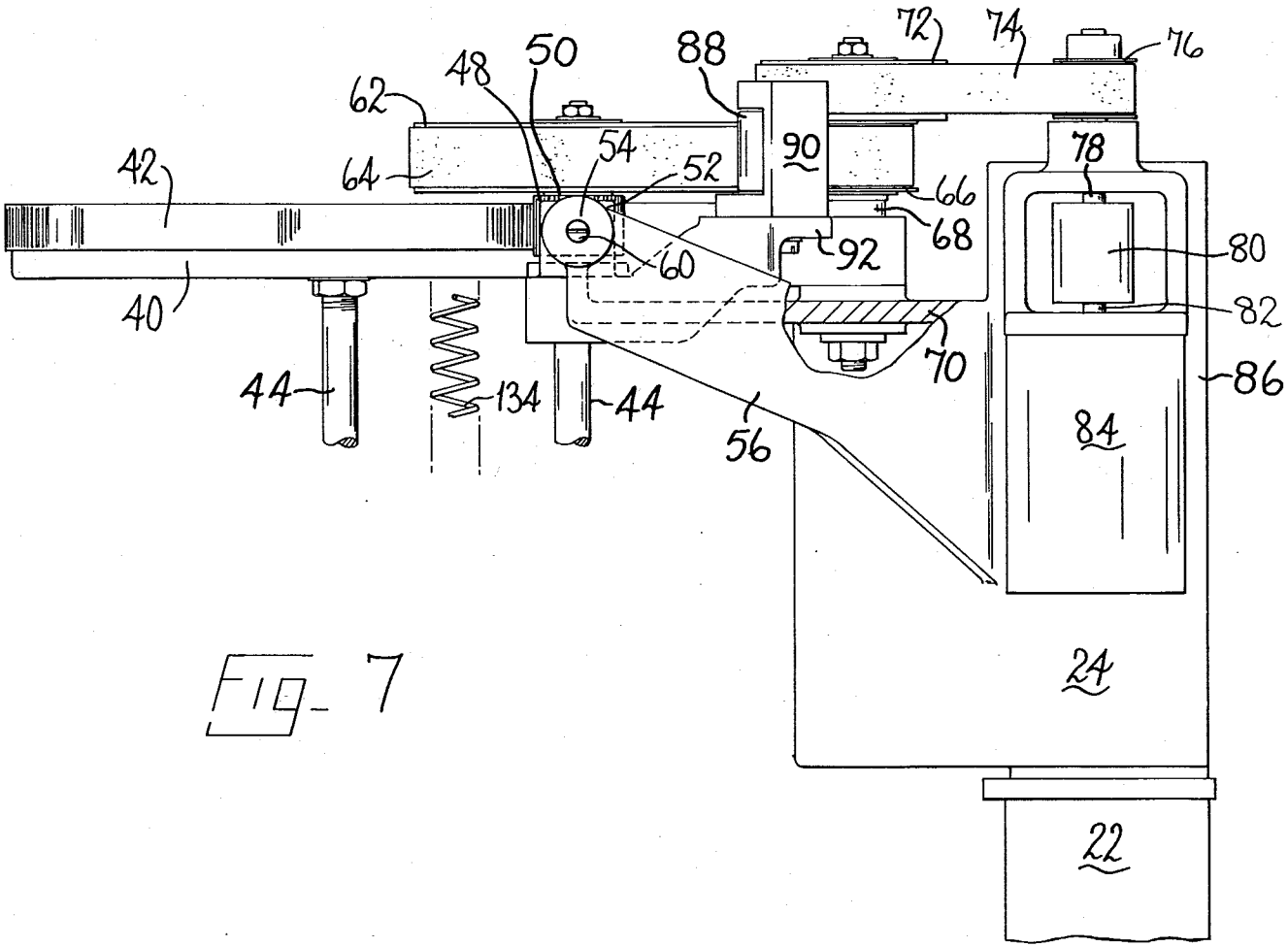
FIG. 7 is a fragmentary view taken along the arrow VII on FIG. 3.

Meshing with the toothed segment is a sprocket 48 (FIGS. 3 and 7) supported on a shaft 50 which is mounted in a block 52 itself supported in a block 54 secured on a bracket portion 56 of the web structure 24, the arrangement being such that the block 52, and thus the sprocket 48 therewith, are urged towards the toothed segment 42 by a spring 58 accommodated in the block 54. An adjustable stop member 60 is provided for varying the tension in the spring.

Also mounted on the shaft 50 is a toothed drive pulley 62, of large diameter in comparison with the sprocket 48, said pulley 62 being operatively connected by a toothed drive belt 64 with a further toothed drive pulley 66, which is mounted on a support shaft 68 itself supported by a flange portion 70 of the bracket 56. Further supported on the shaft 68 and operatively connected with the pulley 66 is a toothed pulley 72 which is operatively connected by a toothed drive belt 74 to a toothed drive pulley 76 supported on a drive shaft 78 which is connected, via a universal coupling 80, to the output drive shaft 82 of a stepping motor 84. The stepping motor 84 is mounted on a bracket 86 secured to the web structure 24, said bracket also supporting end portions of the drive shafts 78, 82 and the universal coupling 80 therebetween.

By applying spring pressure to the block 52, and thus the sprocket 48, any tendency of the sprocket to jump out of meshing engagement with the toothed segment 42, e.g. upon initiation of operation of the stepping motor 84, is resisted. Also, the tension in the belt 64 can be adjusted by means of a tension pulley 88 carried in a slide member 90 supported for sliding movement in a lug portion 92, of the bracket 56.

The stepping motor 84 is thus effective, through the above-described drive arrangement, to cause the arm 30 of the tool supporting means of the illustrative machine to be pivoted widthwise of the bottom of a shoe supported by the shoe support 18 about the vertical axis provided by the shaft 38.

Figure 3:
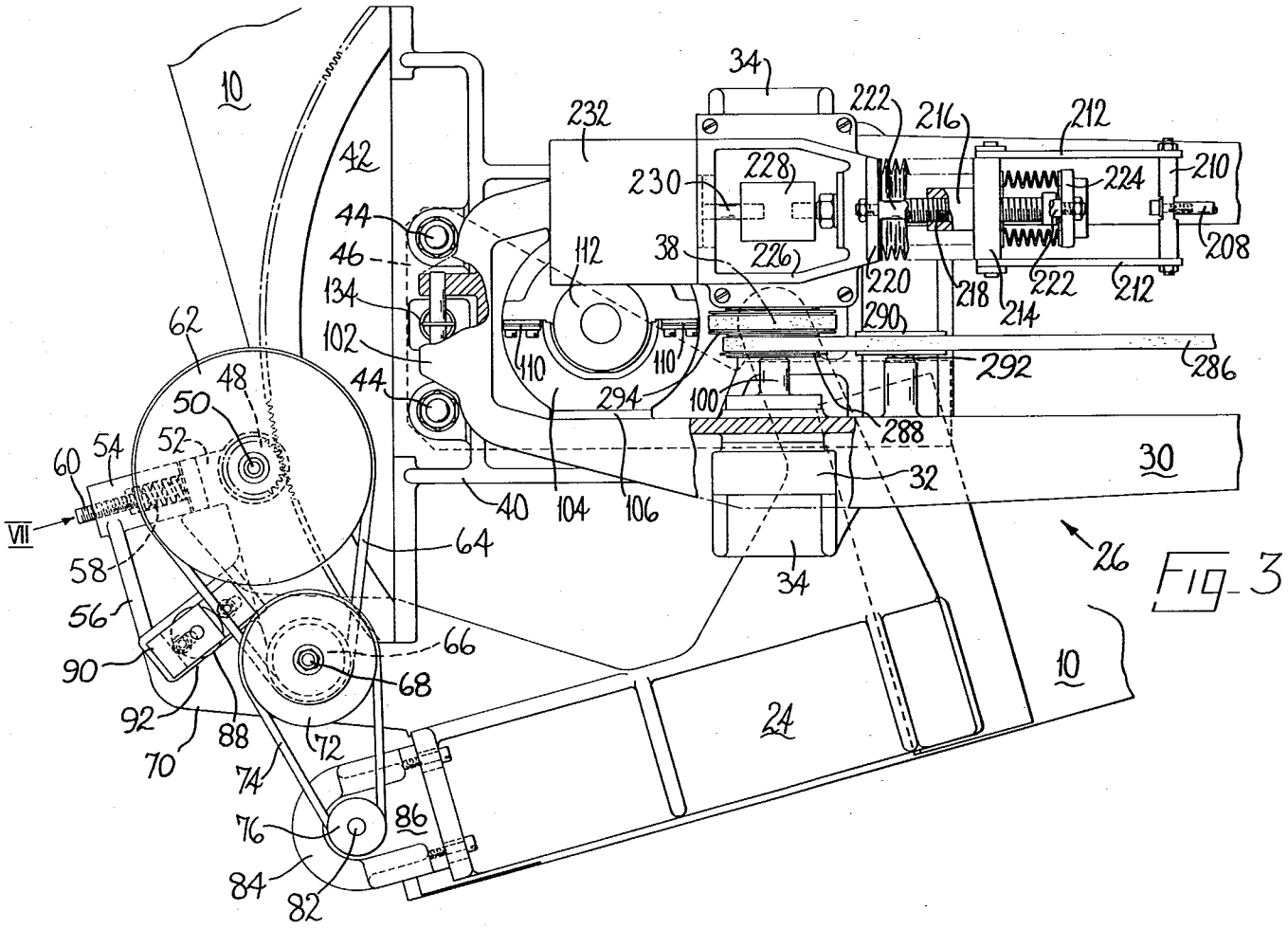
FIGS. 3 and 4 together form a plan view, with parts broken away, of the illustrative machine, showing especially the tool supporting means.

As above mentioned, the arm 30 is also pivotal about a horizontal axis, this axis being provided by pivot pins 100 a left-hand one of which (as viewed from the front of the machine), as shown in FIG. 3, is elongated, as will be referred to hereinafter. For effecting such pivotal movement, a rearwardly extending portion 102 of the arm 30 supports an annular casting 104, said casting being supported for limited pivotal movement in bearings 106 on stub shafts 108. The casting 104 has connected thereto by spring plates 110 a housing 112 for a ball screw arrangement 114 coupled to a drive shaft 116 which is itself coupled, through a universal coupling 118, to an output drive shaft 120 of a stepping motor 122. The drive shafts 116, 120 and also the universal coupling 118 are accommodated in a support frame 124 therefor, to which also the stepping motor is secured. Furthermore, said support frame has opposed lugs 126 which are connected, by spring plates 128 to an annular casting 130 which is itself connected, also by opposed spring plates 132 (arranged at 90° to the spring plates 128), to a depending portion of the rearwardly extending portion 40 of the support casting 34.

Thus, operation of the stepping motor 122 is effective, through the ball screw arrangement 114, to move the rearwardly extending portion 102 of the arm 30 heightwise relative to the rearwardly extending portion 40 of the support casting 34, in which the stepping motor 122 is supported, thereby causing the arm 30 to pivot about the horizontal axis provided by the pivot pins 100. A spring 134 is secured to the rearwardly extending portion 102 of the arm 30 and also the base plate 46 secured to the casting 34 and thus acts the urge the rearwardly extending portion 102 downwardly in relation to the rearwardly extending portion 40 of the casting.

Each shoe support 18 is mounted, as above described, for pivotal movement about is associated pivot shaft 14, such pivotal movement being independent of the other shoe support. For effecting such pivotal movement each structure 16 has secured thereto a toothed segment 140 (one only shown in FIG. 1), and a drive arrangement generally designated 142, which is generally the same as the drive arrangement illustrated in FIG. 7, for use in effecting pivotal movement of the arm about the vertical axis provided by the shafts 36, 38. Each drive arrangement 142 thus also includes a stepping motor 144 operation of which is thus effective to cause pivotal movement of its associated shoe support to take place about the horizontal axis provided by the pivot shaft 14.

Each of the stepping motors 144 constitutes a first stepping motor for effecting relative movement, lengthwise of the bottom of a shoe S supported supported by the shoe support 18 associated with said motor, between said shoe support and the tool supporting means, while the motor 84 constitutes a second stepping motor for effecting relative movement therebetween widthwise of such shoe bottom, and the motor 122 constitutes a third stepping motor for effecting relative movement therebetween heightwise of such shoe bottom.

Figure 2:
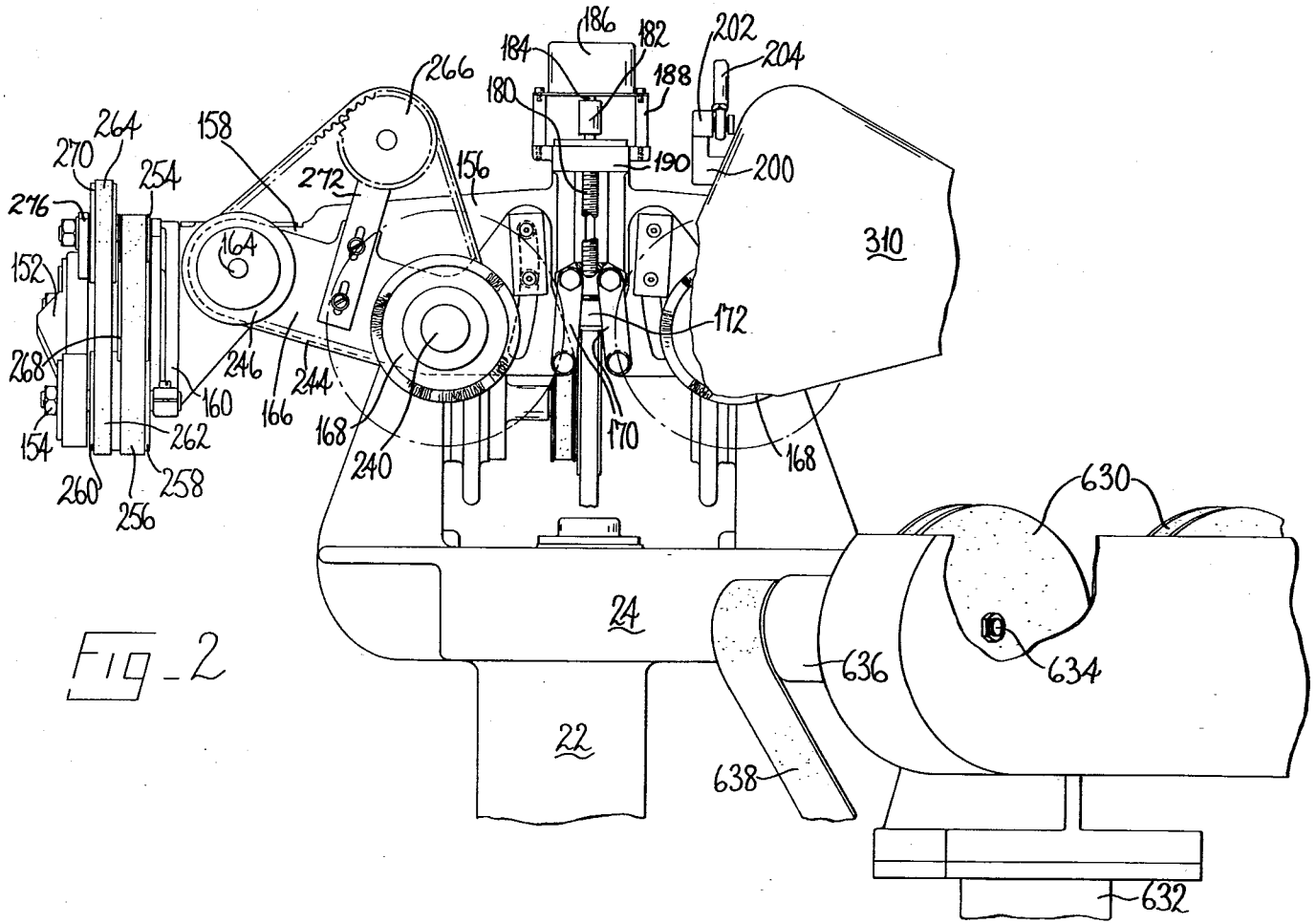
FIG. 2 is a front view, with parts broken away, of the illustrative machine, showing two rotary radial roughing tools and support means therefor.
Figure 4:
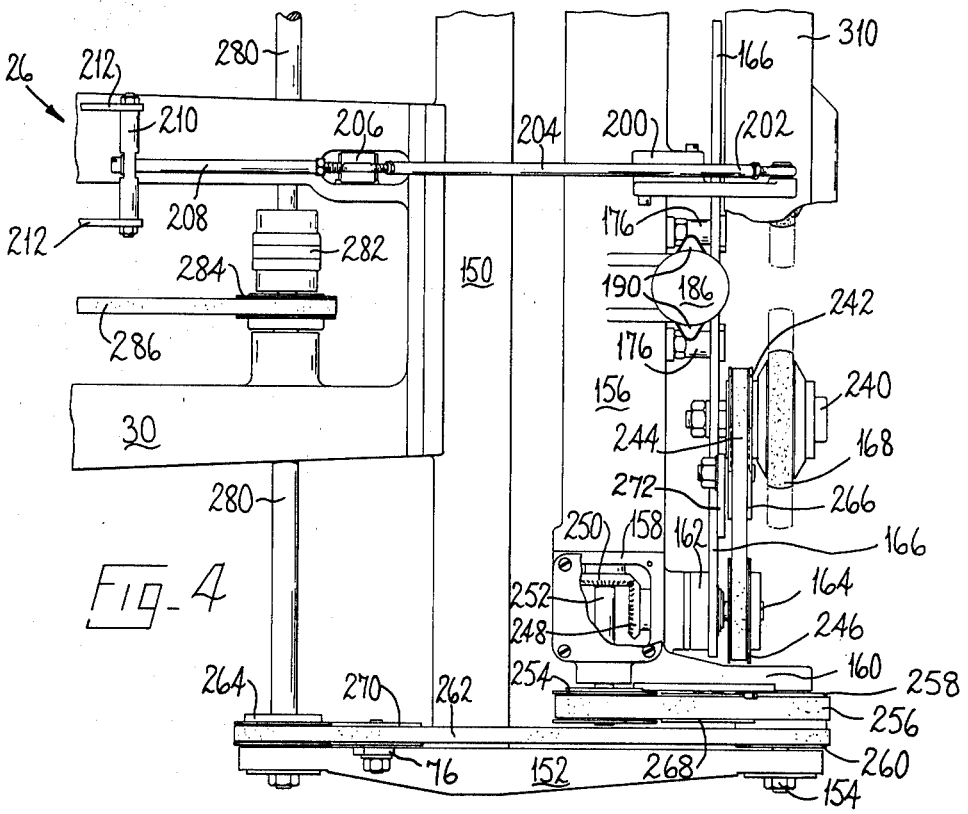
Figure 5:
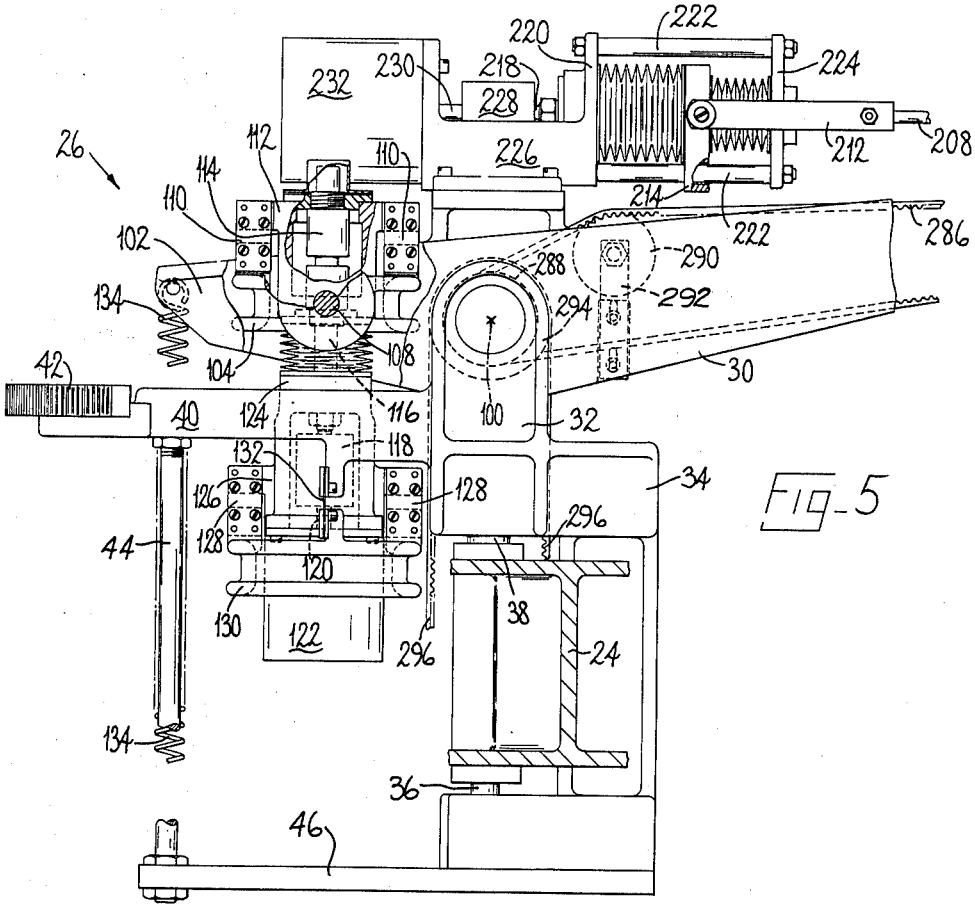
FIGS. 5 and 6 together form a side view of the illustrative machine.
Figure 6:
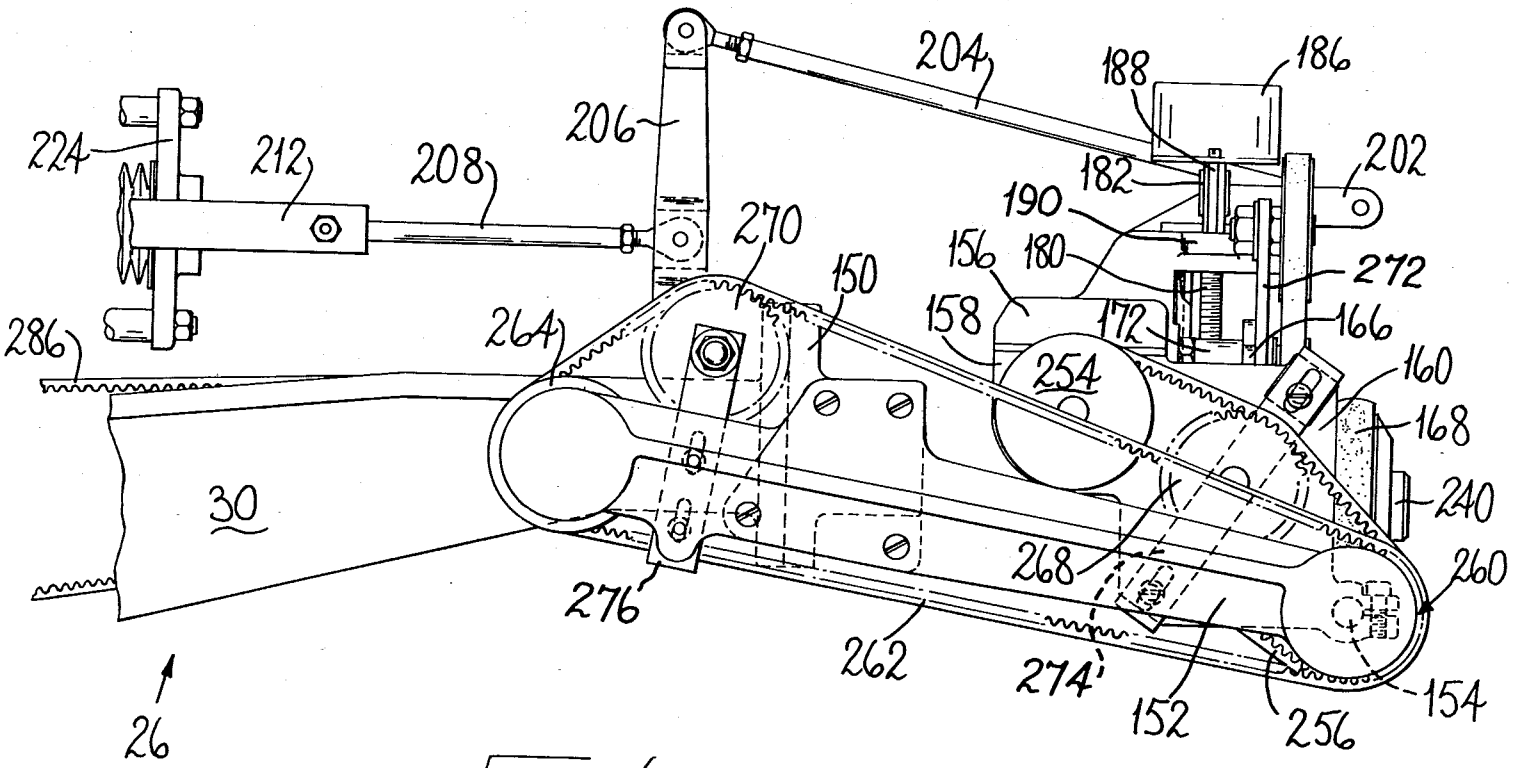

The bifurcated arm 30 of the tool supporting means carries, at its forward end, a bridge member 150 extending transversely of the machine and supporting, at each of the opposite ends thereof, a forwardly projecting arm 152. At the forward end of each arm 152 is a fulcrum pin 154, the pins supporting a generally U-shaped cradle comprising a cross-beam 156, two bevel gear housings 158 arranged one at either end of the cross-beam, and two forwardly projecting arms 160, one connected with each gear housing and supporting at its forward end the pivot pin 154 associated therewith. Mounted on the front face of each housing 158 is a bearing 162 for a forwardly extending shaft 164 on which a transverse support arm 166 is carried, the support arms 166 extending inwardly towards one another and being arranged for pivotal movement about the shaft 164. Towards the inward end of each support arm 166 there is carried a rotary radial roughing brush 168, and each support arm 166 is further supported at its innermost end by a link 170 pivotally connected thereto, opposite ends of the links 170 being carried by a block 172 mounted for limited heightwise sliding movement on a front face of the cross-beam 156. The block 172 threadedly receives a threaded shaft 180 which is coupled through a universal coupling 182 to an output drive shaft 184 of a stepping motor 186 which is supported by a frame 188 on an upstanding boss 190 of the cross-beam 156. The stepping motor 186 is thus effective to cause the block 172, and thus through the links 170 the arms 166 and the roughing brushes 168 supported thereby, to be moved heightwise, such movement enabling the work-engaging surface of each tool 168 to be maintained in a datum plane which passes through the axis of the fulcrum pins 154, e.g. when the brushes 168 have been ground. FIGS. 2 and 4 show in full line the size of a worn roughing brush 168 and in chain-dot line the outline of a roughing brush prior to its use; the work-engaging surface of the worn brushes is shown lying in said datum plane in FIG. 2.

The cradle comprising the cross-beam 156, housings 158 and arms 160 is mounted for pivotal movement on the fulcrum pins 154, thus to cause the roughing brushes 168 to be tilted bodily therewith about an axis in said datum plane and passing through the work-engaging surface of each brush. To this end, the cross-beam 156 has an upstanding bracket 200 to which is fixed a forwardly projecting arm 202 to a forward end of which is pivotally connected a rod 204 extending rearwardly of the illustrative machine and connected, at its other end, to an upper end of a lever 206 which is mounted, at its lower end, on the arm 30 for pivotal movement thereon. Intermediate its ends the lever has pivotally connected thereto a further rod 208 an opposite end of which is threadedly secured in a cross member 210 supported at its opposite ends by two links 212, opposite ends of which are connected to a vertical plate member 214. The member 214 supports a threaded collar 216 through which passes a threaded rod 218 which projects forwardly from, and is mounted for rotation in, a support frame comprising an end plate 220, an upper and a lower support rod 222, projecting forwardly from the end plate, and a front plate 224, in which a forward, necked down, unthreaded portion of the rod 218 is held captive. The end plate 220 is formed integral with a support structure 226, which is hollow and accommodates a universal coupling 228 by which a rearward end of the rod 218, extending through the end plate 220, is connected to an output drive shaft 230 of a stepping motor 232, to which the support structure 226 is bolted. The various components designated 210 to 232 together constitute a stepping motor arrangement 234.

Thus, by actuation of the stepping motor 232, acting through the threaded rod 218 and the plate member 214, the rod 204 is moved fore-and-aft in the illustrative machine thus to cause the cradle on which the roughing brushes 168 are carried to be pivoted about the axis of the fulcrum pins 154. The stepping motor 232 constitutes a fourth stepping motor of the illustrative machine.

The roughing brushes 168 are caused to rotate in contrary directions such that each brush, as it is caused to operate progressively along a marginal portion of the bottom of a shoe S supported by the shoe support, during lengthwise relative movement between the shoe support and the tool supporting means, effects an inwiping action on such marginal portion. For driving the brushes in such manner, each brush is mounted on a spindle 240, each spindle in turn carrying a toothed pulley 242 operatively connected, by a toothed belt 244, to a drive pulley 246. Each pulley 246 is carried on a forward end of the shaft 164 arranged at the same side of the illustrative machine as the roughing brush 168 associated therewith. The rearward end of each shaft 164 carries a bevel gear 248 meshing with a further bevel gear 250, inside said housing 158, each bevel gear 250 being carried on a transversely extending shaft 252 projecting outwardly from the housing 158 and carrying at its outer end a toothed drive pulley 254. Each drive pulley 254 is operatively connected by means of a toothed belt 256 to a further toothed pulley 258 carried on the fulcrum pin 154 at the appropriate side of the machine, each pin 154 carrying also a further toothed pulley 260 which is operatively connected by a toothed driving belt 262 to a further toothed pulley 264.

In order to maintain appropriate tension in each of the toothed driving belts 244, 256 and 262, each also runs about a toothed tension pulley 266, 268, 270 respectively, each tension pulley being supported by a support arm 272, 274, 276 respectively adjustably carried, by a pin-and-slot connection, respectively on the support arms 166, the arms 106 and the arms 152.

The pulleys 264 are supported at opposite ends of a transverse shaft 280, itself supported at its opposite ends in bearings in portions of the arms 152 extending rearwardly of the bridge member 150. The shaft 280 comprises two portions connected by a universal coupling 282 (for ease of disassembly) and further said shaft 208 carries a toothed drive pulley 284 which is operatively connected by a toothed drive belt 286 with a toothed drive pulley 288 carried on the elongated portion of the left-hand pivot pin 100 (see FIG. 3). Tension in the belt 286 is adjustable by means of a tension pulley 290 carried on a support arm 292 adjustably secured, by a pin-and-slot connection, on the arm 30. Also carried on said elongated pin 100 is a further toothed drive pulley 294 which is connected by a toothed drive belt 296 to a toothed drive pulley 298 (FIG. 1) on the output drive shaft of an electric motor 300 carried on a bracket 302 on the base 10 of the machine.

The output speed of the motor 300 and the gearing of the pulleys is such that the brushes are caused to rotate at a speed in the order of 2,900 r.p.m.

The roughing brushes 168 of the illustrative machine are provided with guards 310 which shroud upper portions of the brushes, leaving only the work-engaging surface portion thereof exposed, such guards 310 also incorporating a dust extraction system in the usual manner. One guard only is shown fragmentarily in FIGS. 2 and 4. Other guarding of the machine has been omitted from the drawings for the sake of clarity, but is provided for shrouding the working parts to prevent access thereto by the operator during the operating of the machine; thus, only the shoe supports 18 are accessible to the operator, when they are at a loading station of the machine.

The illustrative machine also comprises two scouring tools 320 (FIG. 1) one associated with each shoe support 18. Each scouring tool comprises an abrasive roll which is mounted on a support shaft 322 carried in bearings at the upper end of a support arm 324. Each support arm 324 is pivotally supported in bearings on a transverse shaft 326, and each shaft is carried at the upper end of a support column 328, the two support columns being mounted, each to the right of its associated shoe support 18 (viewing from the front of the machine), on base plates 330 secured to the base 10. For pivoting each support arm 324, and thus the tool 320 therewith, each arm has an integral bracket 332 connected, by a block 334 pivotally mounted thereon, with a stepping motor arrangement generally designated 336, said arrangement, which incorporates a stepping motor 338, being generally similar to the stepping motor arrangement 234. Thus, actuation of either one of the stepping motors 338 causes its associated support arm 324 to pivot about its transverse shaft 326, thus to bring the scouring tool 320 carried thereby into operative engagement with the bottom of a shoe carried by the shoe support 18 associated with said tool, as the shoe support is moved by the stepping motor 144 as aforesaid.

Each scouring tool 320 is caused to rotate in such a manner that the operating surface portion thereof engaging the shoe moves in the same direction as that of the movement of the shoe therepast; in this way the tool effects an in-wiping action on the toe end portion of the shoe. For rotating the scouring tools 320, each has associated therewith, mounted on the support shaft 322, a toothed driving pulley (not shown) connected by a toothed drive belt 340 to a further toothed drive pulley (not shown) which is mounted on the output drive shaft (not shown) of an electric motor 342. The motors are mounted on the base plates 330. Thus, operation of the electric motors 342 is effective through the drive belts 340 to cause the scouring tools 320 to be rotated.

Figure 8:
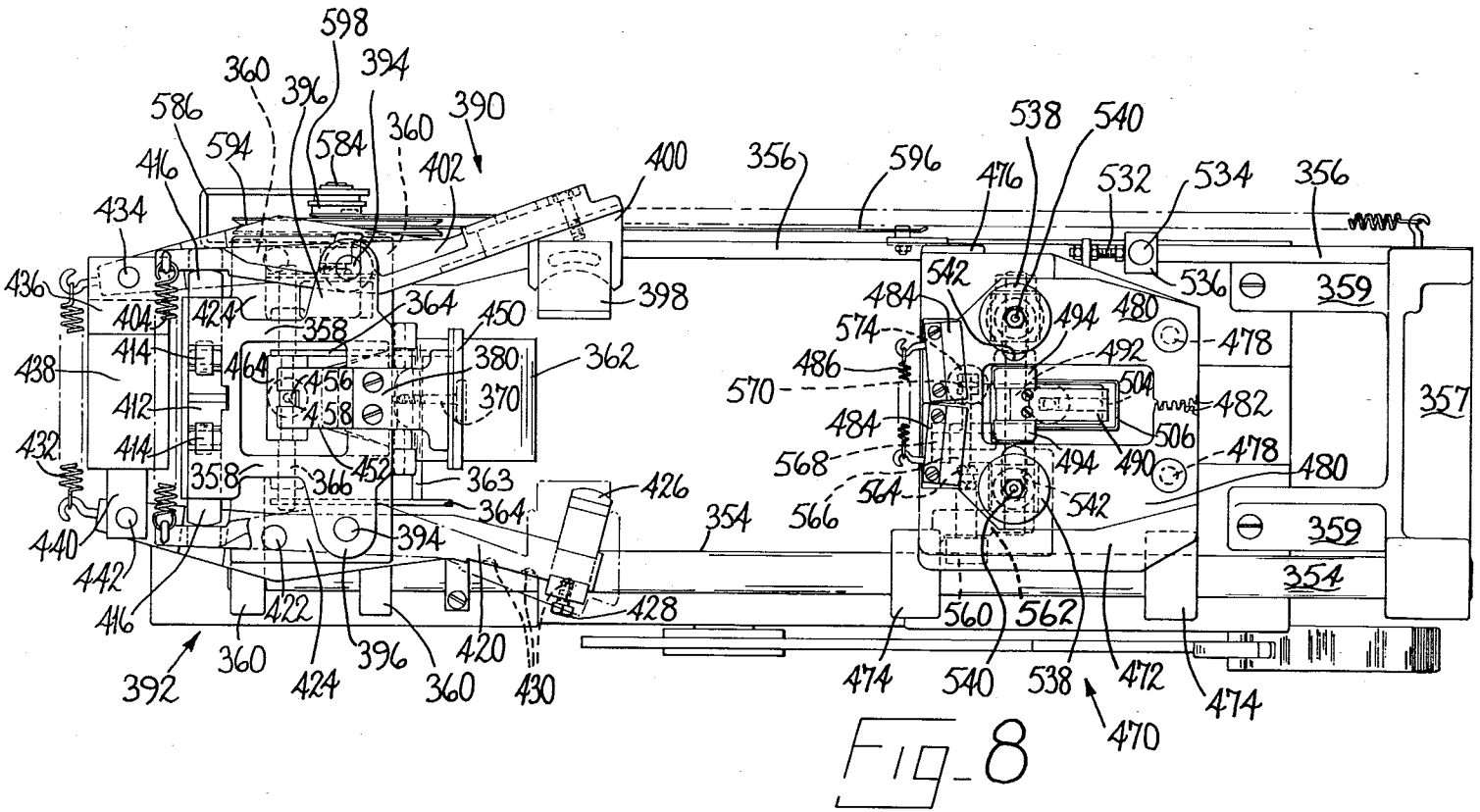
FIG. 8 is a plan view showing details of one of the shoe supports of the illustrative machine.
Figure 9:
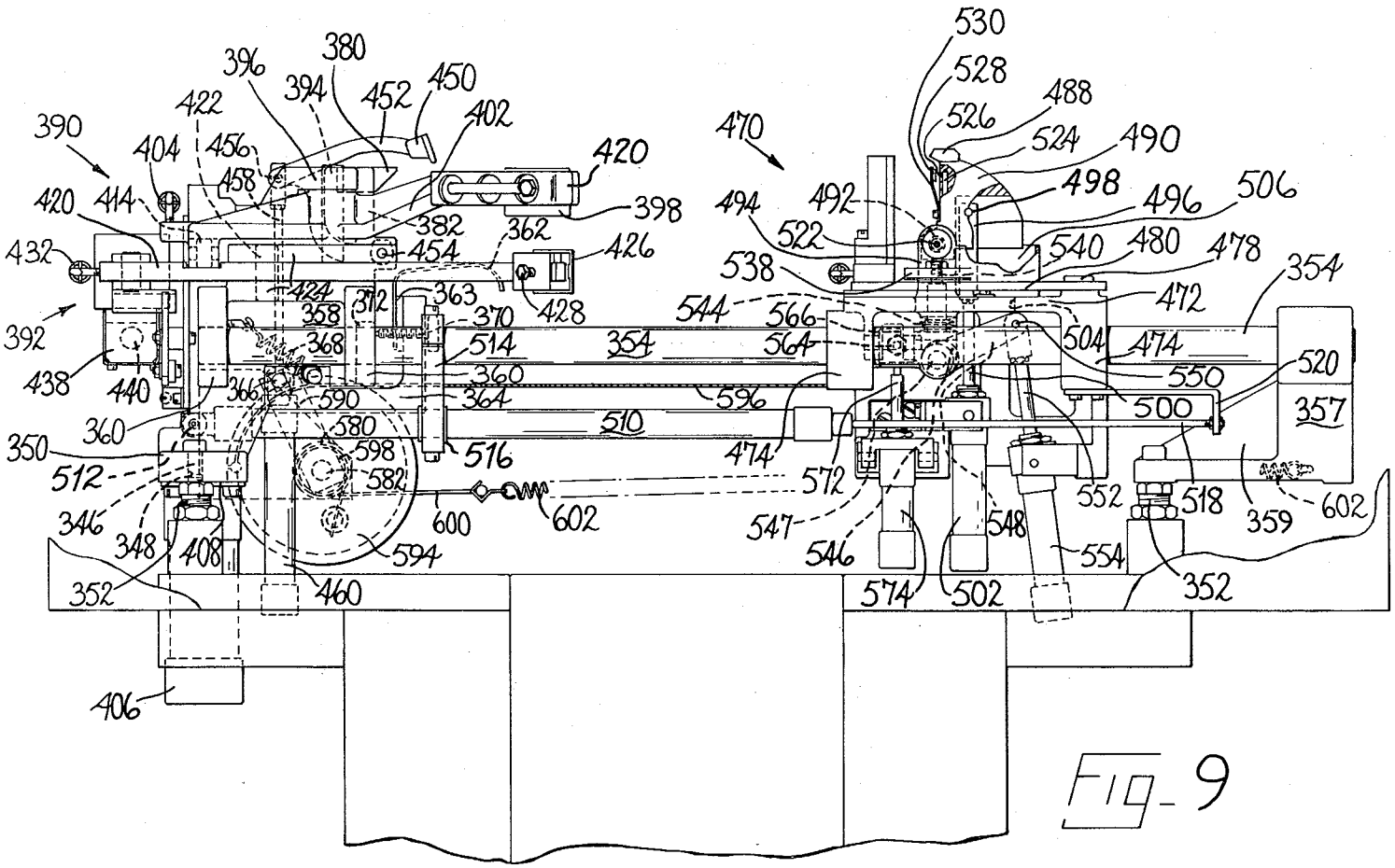
FIG. 9 is a left hand side view of the shoe support shown in FIG. 8.
Figure 10:
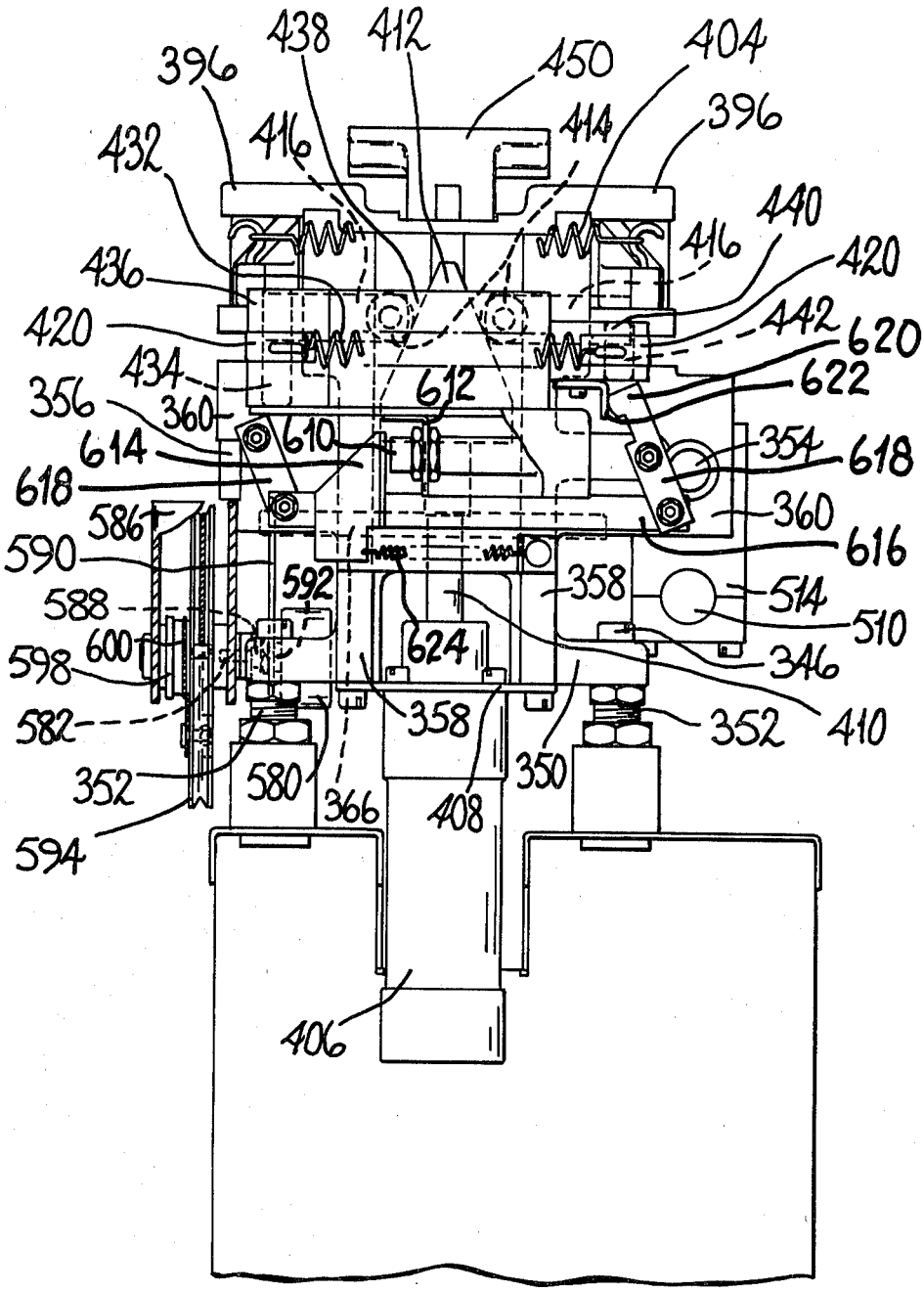
FIG. 10 is a rear view, showing details of part of the shoe support shown in FIGS. 8 and 9.

It will be appreciated that the structures 16 supporting the shoe supports 18 are of the same construction; thus, the drive arrangement 142 for the left-hand shoe support is arranged towards the front of the illustrative machine, while the drive arrangement 142 for the right-hand shoe support is arranged towards the rear thereof. Similarly, the left-hand and right-hand shoe supports are of the same construction (but not of course reversed as in the case of the structures 16). Thus, only one, viz. the left-hand one, of the shoe supports, together with part of the support structure 16 therefor, will now be described in detail with reference to FIGS. 8 to 10.

The support structure 16 is made up of sections of sheet metal appropriately bent and providing four locating studs 352 on which the shoe support 18 is located. The shoe support comprises two parallel rods 354, 356 connected at their right-hand end (viewing FIGS. 8 and 9) by a support casting comprising two walls 358 from each of which extends laterally two plate members 360, each set of plate members having aligned apertures for accommodating the appropriate parallel rods 354, 356 and means being provided for securing said casting to said rods.

The casting has two flange portions 350 extending laterally from the walls 358 and provided with apertures 348 each for receiving a bolt 346 for securing each flange to one of the locating studs 352. In this way the casting is secured to the structure 16.

The casting supports a shoe heel support member 362 which is secured to a plate member 363 carried by two levers 364 arranged at opposite sides of the casting and each being pivotally mounted on a common pivot pin 366, itself being supported at its opposite ends in the walls 358 of the casting. A spring 368 acts on one of the levers 364 to urge the support member 362 upwardly into an operative position, which is determined by an adjustable stop screw 370 carried by the plate member 363 and arranged to abut against a web portion 372 of the casting extending between the walls 358 thereof. If the shoe to be supported is a boot having an elongated leg portion, so that the support member 362 impedes the leg portion of the boot, which can otherwise hang down between the rods 354, 356, the member 362 can be pivoted about the pin 366 downwardly to an out-of-the-way position, the spring 368 thereby passing over the axis of the pin and thus serving to maintain the member in its out-of-the-way position.

The casting of the heel end support arrangement also supports a heel abutment 380 which is made of nylon, said abutment being carried on an upstanding lug portion 382 of the casting extending between the walls 358 thereof. The heel abutment provides a "back datum", i.e. determines the position of the heel seat of the shoe to be operated upon in relation to the casting, and thus to the shoe support 18.

The shoe support 18 also comprises shoe clamping means comprising a first set of clamps 390 and a second set of clamps 392. The first set of clamps 390 are mounted for pivotal movement on pins 394 mounted in lateral lug portions 396 of the casting, each extending outwardly from the wall 358 thereof. Each clamp comprises a clamp pad 398 mounted for limited pivotal movement in a support 400 therefor, said support being carried by arms 402 of the first set of clamps.

Rearward end portions of the arms 402 are urged towards one another by a spring 404 extending therebetween, the spring thus acting to urge the clamp pads 398 of said clamps apart. For uring said clamp pads together, a piston and cylinder arrangement 406 is carried on a plate 408 secured at the rearward end of the walls 358 of the casting, a piston rod 410 of said arrangement supporting a wedge member 412 which acts on rollers 414 carried at one end of rods 416, opposite ends of which each engage with a rearward end portion of the arms 402. Thus, when the piston and cylinder arrangement 406 is energized, the wedge is moved upwardly thereby forcing the rods outwardly, and thus the rearward end portions of the arms 402 therewith, thereby causing the clamp pads to be moved inwardly to engage a shoe positioned against the heel abutment 380. The clamp pads are thus moved in, each through the same distance, so that a shoe supported on the shoe heel support member 362 is centralized thereby, with the longitudinal center line of the heel portion of the shoe coincident with a longitudinal center line of the shoe support 18.

The second set of clamps 392 comprises two arms 420 pivotally mounted on pins 422 carried in flange portions 424 extending outwardly from the walls 358 of the casting. (The upper flange portions 424 also support the lower end of each of the pins 394 carrying the arms 402 of the first set of clamps 390.) Each arm 402 carries at its forward end a clamp member 426 which is locked in position on the arm by a pin 428 which seats in a selected one of a plurality of recesses 430 spaced apart along the outside of the arm 420.

Rearward end portions of the arms 420 are connected by a spring 432, thereby urging said rearward end portions together and thus the clamp members 426 away from one another to an out-of-the-way position. For urging the clamp members 426 towards one another, the right-hand arm is pivotally connected, by a pin 434, in a recess in a block 436 secured to a cylinder of a piston and cylinder arrangement 438 having a piston rod 440 having a bifurcated end portion in which the rearward end of the left-hand arm 420 is pivotally connected by a pin 442. Thus, admission of fluid under pressure to said piston and cylinder arrangement is effective to "extend" the distance between the pins 434, 442, thereby closing the clamp members 426 on to the top line region of an uppper the bottom of which is to be roughed. Furthermore, because of the particular arrangement, the clamping by the second set of clamps 392 is not symmetrical about the longitudinal center line of the shoe support 18, but rather the clamp members 426 can accommodate themselves to the asymmetric shape of the shoe last in the top line region thereof.

For determining the height of the shoe S to be treated when supported in the shoe support 18, a holddown member 450 is provided which, in an operative position, sets the height datum of the shoe bottom. The member 450 overlies the heel support member 362 when in its operative position. The member 450 is carried on an arm 452 which is generally C-shaped (as viewed in FIG. 8) and a lower, bifurcated, end of which is supported on a pivot pin 454 itself carried in lugs formed integral with the walls 358 of the casting. At the upper end of the bifurcated portion of the arm 452 is pivotally connected, by a pin 456, an upper end portion of a piston rod 458 of a piston and cylinder arrangement 460, said arrangement being mounted on a block 464 itself mounted for pivotal movement on a central, reduced diameter, portion of the pivot pin 366. Thus, actuation of the piston and cylinder arrangement 460 is effective to cause the arm 452, and thus the holddown member 450, to move anti-clockwise (viewing FIG. 8) to an out-of-the-way position.

For supporting the toe end portion of a shoe S the bottom of which is to be roughed, the shoe support 18 also comprises toe support means generally designated 470, said means comprising a support casting 471 having two depending aligned bushings 454 in which the rod 354 is accommodated, and a recessed block 476 in which the rod 356 is accommodate. The support casting 452 is thus supported on the parallel rods 354, 356 for sliding movement thereon, towards and away from the heel end support arrangement of the shoe support.

The support casting also provides a horizontal plate portion on which are supported, for pivotal movement about pins 478, two plate members 480 which, at a right-hand end (viewing FIGS. 8 and 9) are provided with intermeshing teeth 482. At a forward end of each plate is provided a block 484 having an inclined shoe-supporting surface thereon, the inclined surfaces facing one another to form a V in which the toe end of a shoe S, facing bottom uppermost, can be accommodated. The blocks are urged together by a spring 486 acting therebetween, the arrangement being such that, when a shoe S is loaded into the shoe support, the blocks 464 are urged away from one another to accommodate the toe width of the shoe to be operated upon, when such shoe is held with the bottom thereof at the height datum determined by the holddown member 450.

Furthermore, for establishing a height datum for the toe end, a datum member 488 is provided carried on a block 490 which is pivotal about a pin 492 carried in upstanding lugs of the casting 472. For pivoting the block 490, and thus the datum member 488, about the pin 492, a link 496 is received in a cut-away portion of the block 490 and is pivotally connected thereto by a pin 498, said link being carried on a piston rod 500 of a piston and cylinder arrangement 502 which is supported by the casting 472 for limited pivotal movement relative thereto. Actuation of the piston and cylinder arrangement 502 is thus effective to cause the block 490, and thus the datum member 488, to be pivoted to an out-of-the-way position, after a shoe S has been clamped by the first and second sets of clamps 390, 392, in order not to impede the roughing of the toe, in the operation of the machine. To facilitate such pivotal movement of the block 490, the casting 472 is provided with a cut-out 504. In order to prevent the operator trapping a finger during such pivotal movement, furthermore, a guard member 506 is provided to prevent access to said cut-out.

The shoe support also comprises means for causing the toe support means 470 to move along the parallel rods 354, 356 towards the heel end support arrangement, said means comprising a piston and cylinder arrangement 510 which is pivotally supported at a left-hand end thereof (viewing FIG. 8) on a pin 512 carried on a depending lug of the left-hand side wall 358 of the casting, and is further supported in a clamp 514 having an aperture with a rubber seating 516 therein for said piston and cylinder arrangement, said clamp being carried by the rod 354. The piston and cylinder arrangement has a piston rod 518 which is connected to a plate 520 attached to the housing for the bushing 474 nearer the heel end support arrangement.

For actuating the piston and cylinder arrangement 510, a sensing arrangement is provided on the block 490 of the toe datum member 488, said sensing arrangement comprising an air bleed which is supplied through a bore 522 in the pin 492 and a connecting bore 524 in the block 490, an outlet 526 for the air bleed being provided in a face of the block 490 facing the V provided by the blocks 484, just below the datum member 488. In front of the outlet 526 is a sealing pad 528 carried by a leaf spring 530 on said face of the block 490. Thus, when the outlet 526 is sealed by the pad 528, a signal is provided by which the piston and cylinder arrangement 510 is actuated. Thus, with a shoe S placed beneath the datum member 488 and effecting the sealing of the air bleed, the toe end support means 470, together with said shoe S, is carried towards the heel end support arrangement for the shoe to be clamped. The piston and cylinder arrangement 510 is actuated under low pressure.

Furthermore, for locating the toe end support means 470 in a loading position, i.e. before it starts to move towards the heel end support arrangement, a stop member 532 is mounted on the casting 472 and is arranged to engage with a buffer 534 secured on the rod 356, said rod 356 being provided with a number of apertures in a selected one of which a mounting 536 for said buffer can be located. Thus, the operator will position the mounting 536 according to the size of the shoes in the particular batch to be operated upon at any particular time.

It will be appreciated that after the holddown member 450 and datum member 488 have been pivoted to their respective out-of-the-way positions, without more the blocks 484 could return towards one another under the action of the spring 486, thereby reducing the cross-sectional size of the V and upsetting the positioning of the shoe to be operated upon. Means is therefore provided whereby the plates 480, and thus the blocks 484, can be clamped in adjusted position, prior to the movement of said holddown member and datum member to their out-of-the-way positions. The plate clamping means comprises, for each plate, a clamp pad 538 carried on an upstanding pin 540 which passes through a slot 542 in the plate 480, the plate thus being movable relative to said pin. Each pin 540 is carried in a boss formed on the horizontal plate portion of the casting 470 and projects downwardly therefrom. At its lower end, each pin has a headed portion, and a plurality of Belville washers 544 act between said headed portion and the boss to urge the clamp pad downwardly on to the plate 480 associated therewith. For relieving the spring pressure of said washers, two cam members 546 are arranged one beneath each headed portion, said members being mounted on a common shaft 548 and the shaft being rotatable, in lugs formed integral with the casting 472, by a crank arm 548 which is pivotally connected by a pin 550 with a piston rod 552 of a piston and cylinder arrangement 554, itself again mounted on the casting 472. When the toe end support means 470 is in its loaded position, the piston and cylinder arrangement 554 is actuated to hold the clamp pads out of clamping engagement with the plates 480. Upon initiation of a cycle of operation of the illustrative machine, however, after the shoe has been loaded, but before the holddown member and datum member are moved to their out-of-the-way position, the piston and cylinder arrangement 554 is deactuated, thereby causing the plates 480, and thus the block 484, to be clamped in adjusted position.

In addition, once the shoe is correctly clamped in the shoe support 18, it is desirable to lock the toe end support means 470 in adjusted position, to which said means has been moved by the piston and cylinder arrangement 510. To this end, a semi-cylindrical clamp member 560 is mounted for sliding movement in a depending lug 562 of the casting 470, said member having a shank with an adjustable stop screw 564 therein against a head of which acts an eccentric portion of a crank arm 566 mounted for pivotal movement on a pin 568, the opposite end of the crank arm being connected by a pin 570 to a piston rod 572 of a piston and cylinder arrangement 574. Again, when the toe end support means 470 is in a loading position, the clamp member 560 is held out of clamping engagement with the rod 354, but, after said toe support means 470 is in an operative position, with a shoe S clamped thereby, said piston and cylinder arrangement 474 is actuated thus to cause the clamp pad clampingly to engage the rod 354, thus to lock the toe end support means 470 in operative position.

The shoe support of the illustrative machine further comprises means for sensing the length of the shoe S to be operated upon, when said shoe is clamped as aforesaid by the shoe support. Said means comprises a rotary potentiometer 580 having an actuator shaft 582 projecting from the body of the potentiometer and being secured in a shaft 584 which is mounted in a U-shaped support member 586 secured on the left-hand wall 358 of the casting of the heel end support arrangement. In order to prevent the housing of the potentiometer 580 from rotating with the actuator shaft 582 thereof, a collar 588 is secured to the housing and carries a lever 590 having a bifurcated end for receiving an extended portion of the pin 366. Thus, the housing 580 is held against rotation when the shaft 584 is caused to pivot. However, relative pivotal movement between the housing 580 and lever 590 can take place, upon release of a locked nut 592, thus to provide a facility for setting the potentiometer prior to the operation of the machine.

Also mounted on the shaft 580 is a large diameter pulley 594 about which runs a cable 596, an end of which is secured to the block 476 on the casting 472 of the toe support means. The cable 596 is maintained taut, so that as the toe support means 470 is moved towards the heel end support arrangement, the cable 596 is drawn in thereby rotating the pulley 594 and the rotary potentiometer 580 therewith. The change in resistance of the potentiometer provides an electrical signal proportionate to the length of the shoe to be operated upon. For maintaining taut the cable 596, which is secured to the pulley 594, a further pulley 598 is also carried on the shaft 584 and rotates with the pulley 594, said pulley 598 also having a cable 600 wound therearound, one end of said cable being fixed and the other being secured to a spring 602 for maintaining the cable 600 taut. Thus, the pulley 598 is constantly urged to rotate anti-clockwise (viewing FIG. 9) thereby maintaining the cable 596 taut also.

The shoe box 18 also has means for determining whether the shoe supported thereby is a left or a right, said means comprising a sensing device 610 carried on a bracket 612 secured on the underside of the block 436 secured to the piston and cylinder arrangement 438. Cooperating with the sensing device is a block 614 mounted, for sliding movement, at the rear of the casting of the heel end support arrangement, on a rod 616 supported on the casting by two parallel links 618. One of the links 618 has an extension 620 arranged to abut with a stop face 622 provided on the underside of the piston rod 440 of the piston and cylinder arrangement 438. A spring 624 acts on the block 614 to urge it towards the sensing device 610.

The sensing device 610 is of the inductance type, thus providing a signal when contacted by the block 614, which differs from the signal emitted thereby when the block is not in contact therewith. In the operation of the machine, the relative positions of the block 436 and piston rod 440, in relation to the center line of the machine, differ according to whether the shoe clamped by the second set of clamps 392 is a left or a right. Thus, if a left shoe is being clamped by the shoe support 18, the piston rod 440 may move further to the left (viewing from the front of the machine) of the longitudinal center line of the shoe support, thereby urging the block 614 away from the sensing device 60. If, on the other hand, a right-hand shoe is placed in the shoe support, the movement of the block 434 will be the greater to the left, thereby carrying the sensor 610 into engagement with the block 614. Should such movement of the device continue after engagement with the block, the parallel links 618 can pivot, bringing the extension 620 out of engagement with the stop face 622, without damage to any of the component parts.

The illustrative machine is computer-controlled, the computer having a storage memory for storing digitized information relating to a number of selected styles of shoe bottoms to be operated upon, the operator selecting the appropriate style for the particular shoe to be operated on in the next cycle of operation; such selection may be through a keyboard (not shown) of the computer. The means for determining whether the shoe next to be operated upon is a left or a right is actuated when the shoe is clamped in the shoe support 18, and this information is passed, by electrical signal from the sensing device 610, to the computer which can then effectively "reverse" the digitized information for the style, according to whether the shoe is a left or a right. Again, the computer has a grading programme, which is operated according to the signal received from the rotary potentiometer 580, and thus according to the size of the shoe bottom to be operated upon. The grading programme is effective to vary the spacing between the digitized points not only lengthwise of the shoe bottom, but also proportionately widthwise thereof.

The computer is thus effective to control the relative positioning of the shoe bottom and the roughing brushes 168 as the latter are caused to operate progressively along opposite marginal portions of the shoe bottom, both lengthwise, heightwise and widthwise of said shoe bottom. Thus, for each digitized point the computer supplies control pulses to the appropriate stepping motor 144, whereby the appropriate shoe support is caused to move the shoe bottom beneath the brushes 168, while simultaneously control pulses are supplied to the stepping motor 84 for effecting movement of the tool supporting arm 30 widthwise of such shoe bottom, and also to the stepping motor 122, whereby the tool supporting arm 30 is pivoted about the axis 100 thus to move the roughing tools 168 heightwise of the shoe bottom. The computer further supplies control pulses to the stepping motor 232 whereby the cradle supporting the roughing tools is caused to pivot about the axis of the fulcrum pins 154 thus to retain the plane of the radial roughing brushes 168 normal or substantially so to the portion of the shoe bottom being operated upon. The control pulses to the stepping motor 232 are determined according to the spacing of the digitized points lengthwise of the shoe bottom, so that they are also modified according to the grading programme. Furthermore, control pulses are supplied to the stepping motor associated with the appropriate scouring tool 320, whereby the scouring tool is lowered on to the shoe bottom, during the roughing operation on the marginal portions of the shoe bottom, thus to scour away pleats formed at the toe end of the shoe bottom in a prior lasting operation, the stepping motor 338 controlling the heightwise position of the scouring tool in relation to the shoe bottom. The operating of the motor 338 is of course also subject to the grading programme of the computer.

The computer means of the illustrative machine is of the so-called open loop type, that is to say there is no constant monitoring of the various moving parts to ensure that they have in fact moved in the manner and to the extent intended. Consequently, it is possible for stepping motor pulses to be "lost" during a machine cycle. Whereas such a loss can be tolerated in any given machine cycle, clearly a cumulative loss over the course of a working day could significantly affect the efficiency of the machine. To this end, in known manner, homing devices are provided, associated with each of the stepping motors 84, 122, 144, 232 and 338. These homing devices, which may be operative at the end and/or beginning of each machine cycle, are effective to ensure that their associated moving parts are at a known datum position prior to initiation of each machine cycle.

In a cycle of operation of the illustrative machine, the operator will generally load the shoe supports 18 alternately; it is not necessary that they be loaded alternately with left and right shoes, since the "hand" of the shoe bottom next to be roughed will be sensed by its supporting shoe support. It may of course be practicable to load left and right shoes alternately from a production point of view. Assuming now that the operator loads a shoe in the left-hand shoe support 18, he will place the toe end of the shoe beneath the datum member 488, thereby triggering the air bleed sensing device and causing the toe support means 470 to be moved bodily towards the heel end support arrangement, such movement being monitored through the cable 596, whereby the length of the shoe to be operated upon is sensed through the rotary potentiometer 580. Movement of the toe end support means 470 is terminated when the shoe is urged against the heel abutment 380. In this position, the heel end portion of the shoe is held against the holddown member 450 by the support member 362, so that the shoe bottom is held with the seat portion and toe end portion thereof in a set heightwise datum position.

When the operator is satisfied with the positioning of the shoe in the shoe support, he initiates the next stage of the operating cycle, whereupon the heel end of the shoe is clamped by the first and second sets of clamps 390, 392, the latter set also sensing whether the shoe is a left or a right, and further the V provided by the blocks 484 of the toe support means 470 is clamped in its position and the block 490 is thereafter pivoted out of the way, the toe support means 470 itself being also clamped in position, these three operations being effected by the piston and cylinder arrangements 554, 502 and 574 respectively. The shoe bottom is thus held exposed in readiness for the roughing and scouring operations to be performed thereon. The shoe support 18 supporting said shoe is then caused to pivot about the axis of the shaft 14 and the tool supporting arm 30 is also caused to pivot about the axis 38, thus to bring the right-hand brush 168 (viewing from the front of the machine) into engagement with the shoe bottom at the heel end thereof, said brush then being caused to operate progressively along the left-hand marginal portion of the shoe bottom from the heel to the toe thereof (as shown in the first drawing of FIG. 1). While the brush is still operating in the heel seat region, furthermore, the scouring tool 320 associated with the selected shoe support 18 is lowered to cause the toe pleats to be scoured away from the shoe bottom; this scouring operation takes place during the marginal portion roughing operation. If any part of the heightwise contour of the shoe bottom is steeply angled, the operating roughing brush 168 is pivoted in its cradle about the fulcrum pins 154 thus to retain the plane of the brush normal to the shoe bottom in the region being operated upon. (This pivoting of the brushes may take place between three or more selected positions, or may be infinitely variable, as desired.)

As the operating brush 168 reaches the toe end, it will be appreciated that the arm 30 is swinging to the right (viewing FIG. 11) following the plan shape of the shoe bottom, and this is considered generally advantageous since as the right-hand brush is moved off the shoe at the toe end thereof, continued movement of the arm brings the left-hand brush into contact with the toe end of the shoe bottom, whereafter the left-hand brush is caused to operate progressively along the right-hand side of the shoe bottom, as the shoe support 18 is returned to the loading position. The dotted lines in FIG. 11 show the relative path between the roughing brushes and the shoe bottom, the solid arrows drawn within the confines of the shoe bottom shape indicating the direction of movement of the shoe support.

While said one shoe is being operated upon as aforesaid, the operator is unloading and reloading the other shoe support 18, so that, when the first-mentioned shoe has been completely operated upon, and the first-mentioned shoe support has returned to its loading position, the next cycle of operation, upon the shoe clamped in the second shoe support can be immediately initiated. When the left-hand tool 168 reaches the heel end of the first-mentioned shoe, the arm 30 is moving to the left, following the plan shape of the shoe bottom. Such movement of the tool arm is immediately thereafter reversed, and the left-hand brush is thus caused to move towards the next shoe clamped in the second shoe support 18, so that the arm is moving at an operating velocity when the left-hand roughing tool 168 comes into contact with the shoe in the second shoe support. Not only does this produce a significant saving in time in the course of a working day, but further the strain on the stepping motor 84 is thus significantly reduced. At the end of the operation on the second shoe, the right-hand brush 168, operating progressively along the left-hand side of the shoe bottom, is moving to the right (viewing FIG. 11) as it leaves contact with the shoe bottom; this movement is again reversed, the arm then being swung to bring the right-hand brush into contact with the heel end of the next shoe to be operated upon, supported by the first-mentioned shoe support 18.

As each brush 168 is caused to operate along a marginal portion of the shoe bottom, the pressure exerted thereby on said shoe bottom is monitored by strain gauges (not shown) carried by the links 170, variation in such applied pressure from a predetermined level (whether it is increased or decreased) causing a signal to be passed from the appropriate strain gauge to the computer, which in turn supplies modulating control pulses to the stepping motor 122, thus to vary the height of the brush 168 whereby to bring the applied pressure back to said predetermined level. In this way, where, for example, the particular shoe S being operated upon varies significantly in its heightwise contour from the selected digitized pattern being followed, modification of said pattern, to compensate for such variation, is achieved.

In order to ensure that the brushes 168 are maintained in a suitable sharpened condition for roughing, the illustrative machine also comprises grinding means, comprising two grinding stones 630 mounted on a support pedestal 632 fixed on the base 10 of the machine, the stones being arranged side-by-side and spaced apart by the same, or substantially the same, spacing as between the roughing brushes 168. Each grinding stone is carried on a spindle 634 rotatable in a collar 636, the collars being independently mounted for pivotal movement on a casting (not shown) carried at the upper end of the support pedestal. Adjustable locking means (not shown) is also provided for locking each collar, and thus each grinding stone, in adjusted heightwise position.

The grinding stones are caused to rotate, in contrary directions to one another, the direction of rotation in each case being such that, when engaged by a rotating roughing brush 168, the operating surface of each stone is moving in the same direction as the operating surface of the roughing brush engaged thereby. For rotating the stones 630, a single motor (not shown) is provided, mounted on the base 10 of the machine, and operatively connected to pulleys (not shown) on the spindle 634 by means of a drive belt 638, further pulleys (also not shown) being provided both maintaining the tension in the belt 638 and also for the purpose of driving the stones in contrary directions as aforesaid.

The illustrative machine may be so arranged that a grinding operation takes place after a predetermined number of machine cycles, or alternatively when the operator considers a sharpening operation is required. In either case, for a grinding operation the arm 30 is caused to pivot about its vertical axis, under the action of the stepping motor 84, to bring the roughing brushes 168 into opposed relationship with the grinding stones 630. Thereafter, the stepping motor 122 is actuated to move the brushes 168 into proximity (or engagement, according to the amount of brush wear since the previous grinding operation) with the grinding stones. In the operation of the illustrative machine, the motor 122 operates to bring the datum plane, which passes through the axis of the fulcrum pins 154, to a position in which the uppermost portion of the operating surface of each stone lies in said datum plane. Thereafter, in order to ensure that a grinding operation takes place on the brushes, and further in order to ensure that the brushes, when ground, are of uniform diameter, the stepping motor 186 is actuated to cause the brushes 168 to be moved downwardly, through a relatively small "grinding" distance, relative to the arm 30 of the tool supporting means. It will of course be appreciated that, in this manner, the grinding stone 630 will grind away any portion of the operating surface of each brush, thus to maintain the lowermost portion of the operating surface of each brush in said datum plane. When the grinding operation is completed, the motor 122 is again actuated to return the arm, and the brushes 168 therewith, to an operating position, in readiness for the next roughing operation.

For providing the digitized information to the computer control means of the illustrative machine, digitizing may be effected in the machine itself, and to this end the illustrative machine comprises manually operable control means (not shown), including a joy-stick by which in a digitizing mode of the machine, the stepping motors can be caused to be driven in directions, selected by the joy-stick, thus to cause a tool supported by the tool supporting means to be moved in relation to the bottom of a shoe supported by one of the shoe supports. Thus, the tool can be positioned at selected points along the shoe bottom marginal portions by the operator. Furthermore, the computer control means comprises a "teach" circuit by which, for each such selected point, the position of the tool, lengthwise, widthwise and heightwise of the shoe bottom marginal portion, is stored by the computer control means in a programmed instruction in terms of digitized co-ordinate axis values. The shoe which is digitized may be a left or a right, the sensing means of the shoe support indicating to the computer control means whether the shoe is a left or a right. In addition, the shoe length detecting arrangement of the shoe support supplies appropriate information to the computer control means for subsequent grading purposes in the operating mode of the machine.

It will of course be appreciated that the computer control means also has an interpolating programme for "joining" the digitized points, thus to provide control for a continuous path of relative movement between the brushes 168 and the shoe bottom being operated upon, lengthwise, widthwise and heightwise of such shoe bottom.

Furthermore, the computer control means has a "brush tilt" determining programme, said programme serving to calculate the gradient of the shoe bottom between each pair of successive points (by calculating the ratio between the amount of lengthwise movement and the amount of heightwise movement between such points) and supplying appropriate drive pulses to the stepping motor 232. The calculation of the gradient as aforesaid takes place at the time of digitizing the points; as an alternative however, the calculation could be made, during the operating mode of the machine, in each operating cycle.

Whereas the strain gauge referred to above ensures that the load applied by the brushes 168 to the shoe bottom remains at the predetermined level, it may be that different load levels can advantageously be applied over different sections of the shoe bottom. To this end, the control means of the machine also includes a selector device (not shown) whereby the operator can selectively increase or decrease the load to be applied in any one of a predetermined number of sections of the shoe bottom; in most cases it will be necessary only to divide the shoe bottom into three sections, viz. forepart, waist and heel seat. (In addition, it is envisaged that a load setting can be made for each point during the digitizing of the shoe bottom in a digitizing mode of the machine, the selector device serving merely to allow adjustments to be made, as the operator considers necessary or desirable.)

Further to enable the operator to control the degree of rough, the control means of the machine also comprises speed setting means (not shown) whereby the speed of relative movement between the shoe support and the tool supporting means can be adjusted according to the properties of the shoe bottom marginal portions of which are to be roughed, the arrangement being such that the slower the speed of traverse of the tool relative to the shoe bottom, the greater the degree of rough, and vice versa.

We claim:

1. In a machine for performing marginal roughing and toe scouring operations on shoe bottoms comprising a shoe support for supporting a shoe, bottom uppermost, roughing tool supporting means for supporting a roughing tool, between which shoe support and roughing tool supporting means relative movement can take place, lengthwise, widthwise and heightwise of the bottom of a shoe supported by the shoe support, whereby a roughing tool supported by the roughing tool supporting means is caused to operate progressively along marginal portions of the shoe bottom, and toe scouring tool supporting means between which and the shoe support relative lengthwise and heightwise movement can be effected thus to cause the toe end portion of the bottom of a shoe supported by the shoe support to be scoured: the improvement in that a first stepping motor is provided for effecting relative lengthwise movement between the shoe support and the scouring tool supporting means, a further stepping motor is provided for effecting relative heightwise movement therebetween, and computer control means is provided by which drive signals are generated and supplied to said stepping motors in accordance with a programmed instruction, so that a scouring tool supported by the scouring tool supporting means is caused to follow a pre-determined path lengthwise and heightwise of the shoe bottom, whereby to control the amount of material remaining after the scouring operation has been effected on the shoe bottom.

2. A machine according to claim 1 wherein second and third stepping motors are provided, by which relative movement, widthwise and heightwise of the shoe bottom, is effected between the shoe support and the roughing tool supporting means, the computer control means generating and supplying drive signals to the first, second and third stepping motors in accordance with a programmed instruction including digitised co-ordinate axis values, using three co-ordinate axes, for a plurality of successive selected points along the marginal portions of the bottom of the or a similar shoe, and further wherein the pre-determined path of the scouring tool is derived from the digitised co-ordinate axis values forming part of the programmed instruction by which the marginal roughing operation is controlled.

3. A machine according to claim 1 wherein the shoe support is mounted for movement relative to the scouring tool supporting means about a horizontal axis, so that the shoe support moves through an arcuate path, the arrangement being such that a roughing tool supported by the roughing tool supporting means is located adjacent the highest point of said path, or substantially so, and a scouring tool supported by the scouring tool supporting means is located just "upstream" of the such roughing tool.

4. A machine according to claim 1 wherein the scouring tool is in the form of a rotary abrasive member which is driven in such a manner that the direction of relative movement between the shoe bottom and the operating surface of the tool engaging it is the same as that in which relative lengthwise movement is taking place between the scouring tool supporting means and the shoe support.

5. A machine according to claim 1 comprising two shoe supports arranged side-by-side, into alignment with each of which alternately the roughing tool supporting means can be moved, whereby successive roughing operations can be performed on the bottom of a shoe supported by one of said supports and then on the bottom of a shoe supported by the other of said supports, and further wherein two scouring tools are provided, one associated with each shoe support and each having a further stepping motor associated therewith, the arrangement being such that, in a cycle of operation, the scouring tool associated with the shoe support with which the roughing tool supporting means is brought into operative alignment as aforesaid is rendered operative.

6. A machine according to claim 1 wherein the shoe support has a shoe length detecting arrangement associated therewith, by means of which the length of a shoe supported by the shoe support can be "read", and wherein the computer control means has a grading programme which, in response to a signal from the shoe length detecting arrangement, causes the drive signals to the stepping motors to be modulated in accordance with the shoe length thus detected.

* * * * *